US007073558B1

(12) United States Patent
Nakajima

(10) Patent No.: US 7,073,558 B1
(45) Date of Patent: Jul. 11, 2006

(54) PRODUCTION METHOD FOR POROUS METAL BODY

(76) Inventor: Hideo Nakajima, 6-40, Goban-cho, Hiyoshidai, Takatsuki-shi, Osaka 569-1022 (JP)

( * ) Notice: Subject to any disclaimer, the term of this patent is extended or adjusted under 35 U.S.C. 154(b) by 372 days.

(21) Appl. No.: 10/030,732

(22) PCT Filed: Jul. 10, 2000

(86) PCT No.: PCT/JP00/04567

§ 371 (c)(1),
(2), (4) Date: Jan. 8, 2002

(87) PCT Pub. No.: WO01/04367

PCT Pub. Date: Jan. 18, 2001

(30) Foreign Application Priority Data

Jul. 9, 1999 (JP) ..... 11/195260

(51) Int. Cl.
*B22D 27/00* (2006.01)
*B22D 27/13* (2006.01)

(52) U.S. Cl. ..... 164/66.1; 164/79
(58) Field of Classification Search ..... 164/79, 164/66.1
See application file for complete search history.

(56) References Cited

U.S. PATENT DOCUMENTS

| | | | | |
|---|---|---|---|---|
| 3,692,513 A | | 9/1972 | Hall et al. | 75/415 |
| 5,181,549 A | * | 1/1993 | Shapovalov | 164/79 |
| 5,384,203 A | * | 1/1995 | Apfel | 428/613 |
| 6,263,953 B1 | * | 7/2001 | Emil | 164/475 |

FOREIGN PATENT DOCUMENTS

| | | | |
|---|---|---|---|
| JP | 59-129740 | * | 7/1984 |
| JP | 3-17236 | * | 1/1991 |
| JP | 3-294437 | * | 12/1991 |
| JP | 5-59462 | * | 3/1993 |
| JP | 10-88254 | | 4/1998 |
| JP | 10-158761 | * | 6/1998 |
| JP | 2000-239760 | | 9/2000 |

* cited by examiner

*Primary Examiner*—Kevin P. Kerns
(74) *Attorney, Agent, or Firm*—Knobbe, Martens, Olson & Bear, L.L.P.

(57) ABSTRACT

A process for producing a metal body comprises (1) a step of maintaining under reduced pressure a metal material within a temperature range of room temperature to a temperature lower than a melting point of the metal in a sealed vessel to thereby degas the metal material, (2) a step of melting the metal material under pressurization by introducing a gas into the sealed container to thereby dissolve the gas into the molten metal, and (3) a step of cooling and solidifying the molten metal while controlling a gas pressure and a molten metal temperature in the sealed vessel to thereby form a porous metal body.

14 Claims, 27 Drawing Sheets

PRODUCTION METHOD FOR POROUS METAL BODY

This application is the U.S. National Phase under 35 U.S.C. §371 of International Application PCT/JP00/04567, filed Jul. 10, 2000, which claims priority to Japanese patent application Ser. No. 11/195,260, filed Jul. 9, 1999. The International Application was published under PCT Article 21(2) in a language other than English.

TECHNICAL FIELD

This invention relates to a process for producing a porous metal body.

There are known porous metal bodies and methods for producing them. For instance, the specification of U.S. Pat. No. 5,181,549 discloses a process for producing a porous metal body by dissolving hydrogen or hydrogen-containing gas in a molten raw metal material under pressurization, and then cooling and solidifying the molten metal under the condition of controlling the temperature and pressure.

However, this method has some serious practical problems. For example, (1) an ultra-pure metal must be used as the raw material in order to obtain a porous metal body having excellent characteristics, (2) oxygen, nitrogen, hydrogen or other impurities, if contained in the raw metal material, remain in the porous metal body and impair the characteristics of the resulting porous metal body, limiting the field of use of the porous metal body, and (3) since hydrogen or hydrogen-containing gas is used as a gas to be dissolved in molten metal, the metal species to be used are limited to those giving a porous metal body which is not subject to the impairment of characteristics due to hydrogen absorption.

DISCLOSURE OF THE INVENTION

The inventor conducted researches in light of the above-mentioned problems encountered with the prior art porous metal body producing technology, and as a result discovered that a high-quality porous metal body can ultimately be obtained by lowering the amount of impurities contained in the metal to or below a specific value before and during the melting of the raw metal material.

More specifically, the present invention provides the following processes for producing a porous metal body.

1) A process for producing a porous metal body comprises the steps of:

(1) maintaining under reduced pressure a raw metal material within a temperature range from room temperature to a temperature lower than the melting point of the metal in a sealed vessel to thereby degas the raw metal material;

(2) melting the raw metal material under pressurization by introducing a gas into the sealed vessel to thereby dissolve the gas in the molten metal; and (3) cooling and solidifying the molten metal in a mold while controlling the gas pressure and the temperature of the molten metal inside the sealed vessel to thereby obtain the porous metal body.

2) In the process for producing a porous metal body according to item 1) above, the metal is selected from the group consisting of iron, copper, nickel, cobalt, magnesium, titanium, chromium, tungsten, manganese, molybdenum, beryllium, and alloys comprising one or more of these metals.

3) In the process for producing a porous metal body according to item 1) above, the reduced pressure in step (1) is $10^{-1}$ Torr or lower.

4) In the process for producing a porous metal body according to item 3) above, the reduced pressure in step (1) is between $10^{-1}$ and $10^{-6}$ Torr.

5) In the process for producing a porous metal body according to item 1) above, the metal material in step (1) is maintained at a temperature which is 50 to 200° C. lower than the melting point of the metal.

6) In the process for producing a porous metal body according to item 1) above, the gas used in steps (2) and (3) is at least one member selected from the group consisting of hydrogen, nitrogen, argon and helium.

7) In the process for producing a porous metal body according to item 1) above, the pressure applied in step (2) is between 0.1 and 10 MPa.

8) In the process for producing a porous metal body according to item 7) above, the pressure applied in step (2) is between 0.2 and 2.5 MPa.

9) In the process for producing a porous metal body according to item 1) above, the molten metal is poured in step (3) from the sealed vessel into the mold equipped with a cooling apparatus.

10) In the process for producing a porous metal body according to item 1) above, the cooling and solidification of the molten metal in step (3) is performed by a continuous casting method.

EMBODIMENTS OF THE INVENTION

Figure 1:
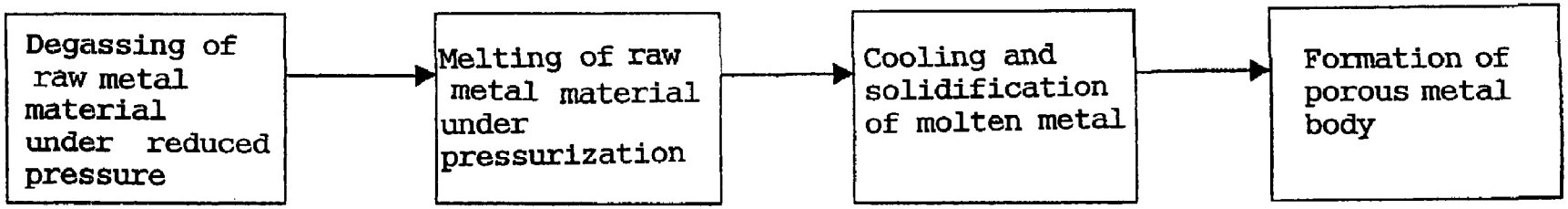
FIG. 1 is a flow diagram illustrating the general outline of producing steps of the porous metal body according to the present invention.

In the present invention, as shown in FIG. 1, first the metal which serves as the raw material for producing a porous body is placed in a vessel with a sealed construction, and the raw metal material is kept under reduced pressure within a temperature range from normal temperature to a temperature less than the melting point of the metal to thereby degas the metal material (step (1)).

Next, the degassed metal material is heated under pressurization with a given gas to thereby melt the metal material and dissolve the gas in the molten metal (step (2)).

Then, while controlling the pressure of the gas and the temperature of the molten metal in the sealed vessel according to the type of pressurizing gas and raw metal material, the molten metal is cooled and solidified to thereby form a desired porous metal body (step (3)).

Usable as the raw metal materials are iron, copper, nickel, cobalt, magnesium, aluminum, titanium, chromium, tungsten, manganese, molybdenum, beryllium, and an alloy comprising one or more of these metals.

The degassing may be performed by placing a raw metal material composed of a suitable combination of two or more kinds of simple substance metals in the sealed vessel. Alternatively, as the raw metal material, a concomitant use of at least one simple substance metal and at least one alloy, or a concomitant use of two or more alloys is possible. In these cases, an alloy is formed in the melting step which will be discussed below and the porous alloy material is ultimately obtained.

How much the pressure is reduced in step (1) varies depending on the type of raw material metal and on the impurity components (such as oxygen, nitrogen and hydrogen) which are contained in the raw material metal and should be removed, but the pressure is usually $10^{-1}$ Torr or lower, preferably within the range of $10^{-1}$ to $10^{-6}$ Torr. If the pressure reduction is insufficient, the remaining impurity components may impair the corrosion resistance, chemical resistance, toughness and so forth of the porous metal body. On the other hand, excessively reduced pressure improves the performance of the resulting porous metal body somewhat, but increases the costs of producing and operating the apparatus, hence undesirable.

The temperature at which the raw metal material is maintained in step (1) is between ordinary temperature and a temperature lower than the melting point of the raw metal material (when two or more different metals are used together, lower than the lowest melting point), and preferably about 50 to 200° C. lower than the melting point. The operation is easier if the degassing is performed by placing the raw metal material in the sealed vessel at normal temperature, and then gradually raising the temperature. To enhance the degassing effect, it is preferable to heat the raw metal material at a temperature which is as high as possible but still under the melting point of the raw metal material, prior to the start of step (2). When the raw metal material is maintained at a higher temperature in step (1), the time required for melting the metal to be discussed below is shorter.

The time period during which the metal is maintained in step (1) may be suitably determined depending on the type and amount of impurities contained in the metal, the extent of degassing required and the like.

The degassed raw metal material is then melted under pressurization in step (2). As the pressurizing gas, one or more of hydrogen, nitrogen, argon and helium is used.

If safety is of particular importance, it is preferable to use at least one of nitrogen, argon and helium as the pressurizing gas. It is also preferable to use a nitrogen-argon mixture, a nitrogen-helium mixture or a nitrogen-argon-helium mixture in order to more accurately control the porosity and pore size within the porous metal body.

In this step (2), part of the gas is dissolved in the molten metal under pressurization. As shown in the metal-gas system phase diagram shown in FIG. 2, it is preferable that the amount of gas dissolved in the molten metal falls within a certain range including a formation amount at the eutectic point $C_3$ under the given pressurization conditions. The amount of gas dissolved in the molten metal is determined by taking into account such factors as the type of metal, the type of gas, the gas pressure, and the desired pore structure of the porous metal body.

The pressurization condition in step (2) is determined according to the type of metal and the pore shape and diameter, the porosity and so forth of the porous metal body ultimately obtained, but is usually about 0.1 to 10 MPa, more preferably 0.2 to 2.5 MPa.

Any pressurizing gas may be selected from the group of gases given above, as long as it does not inhibit the characteristics of the porous metal body eventually obtained. However, there are preferred combinations of metal and gas. Examples of such preferred combinations include iron-nitrogen/argon ("nitrogen/argon" means a mixed gas of nitrogen and argon; the same applies hereinafter), iron-nitrogen/helium, an iron alloy (industrial-grade pure iron, ordinary steel, stainless steel, etc.)-nitrogen/argon, an iron alloy (ordinary steel, stainless steel, etc.)-nitrogen/helium, copper-argon, copper-hydrogen, copper-hydrogen/argon, and nickel-nitrogen/argon.

The molten metal in which gas has been dissolved is then sent to step (3), where it is cooled and solidified. As shown schematically in FIG. 3, the amount of gas dissolved in the metal differs dramatically above and below the melting point. Specifically, a large quantity of gas dissolves in metal in a molten state, but as the temperature falls and the metal begins to solidify, there is a sharp reduction in the amount of dissolved gas. Therefore, by solidifying the molten metal in a certain direction while suitably controlling the temperature of the molten metal and the gas atmosphere pressure, bubbles can be produced in the solid phase portion near the solid phase/liquid phase interface due to the separation of gas which has been dissolved to supersaturation in the liquid phase portion. Since these gas bubbles grow as the metal solidifies, numerous pores are formed in the solid phase portion. In this step (3), as will be discussed in further detail below, a porous metal body in which the pore shape, pore diameter, porosity and so forth are controlled as desired is obtained by controlling the cooling rate or the solidification rate of the molten metal and suitably adjusting the composition of the solidification gas atmosphere (the mixing ratio of nitrogen gas/inert gas) and the gas pressure (increasing the pressure, maintaining the pressure, or reducing the pressure).

Figure 4:
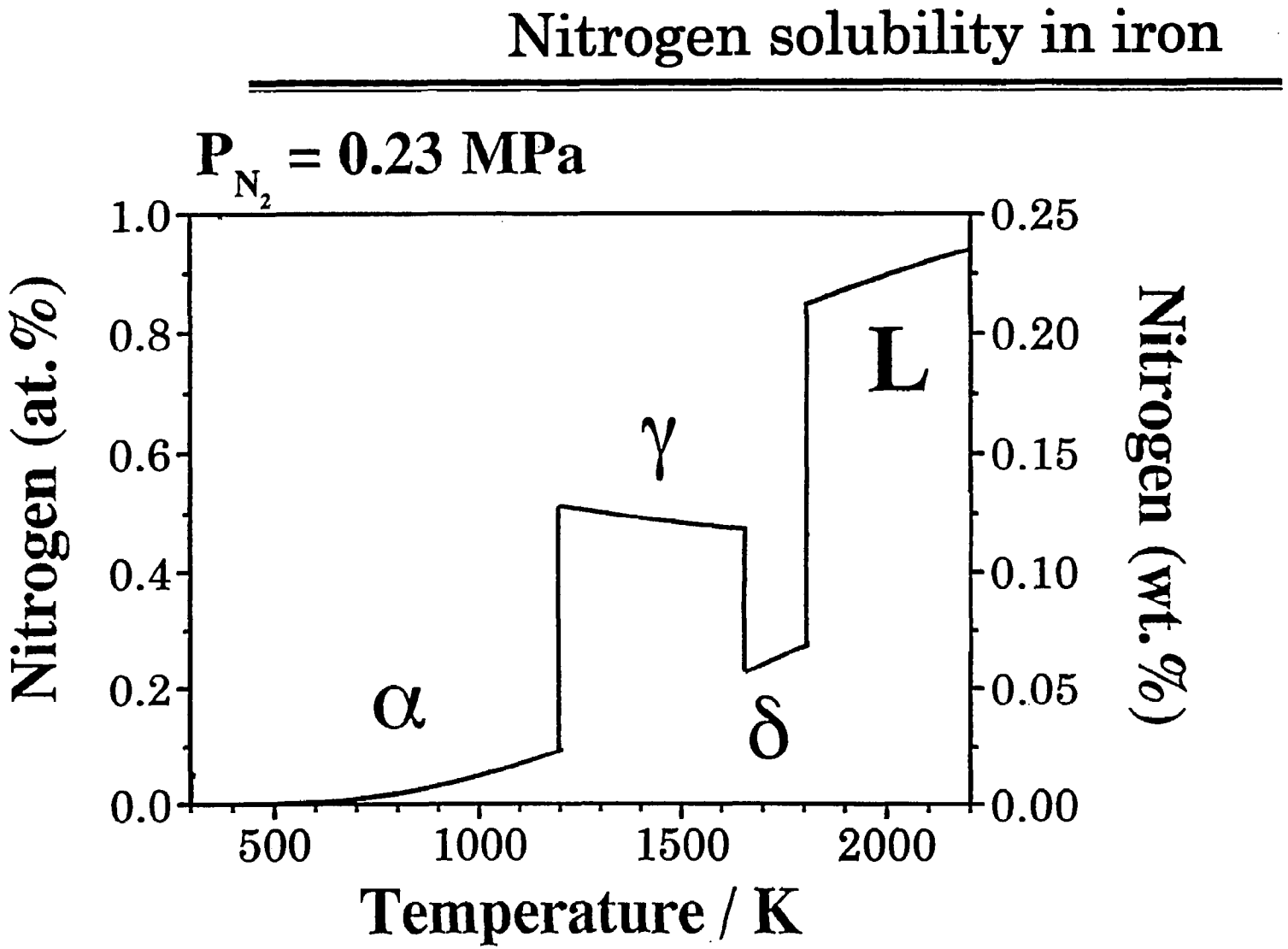
FIG. 4 is a graph showing in detail the amount of nitrogen dissolved in pure iron (99.99%) above and below the melting point of the pure iron.

FIG. 4 is a graph illustrating in detail the change in the amount of dissolved nitrogen (the left vertical axis shows concentration in the liquid phase, and the right vertical axis shows concentration in the solid phase) in pure iron (99.99%) that has been maintained under pressurization of 2.3 MPa with a nitrogen/argon mixed gas.

As is clear from FIG. 4, the nitrogen solubility in liquid iron and solid iron varies sharply and irregularly in the transition from the melt to solidification of pure iron. Even in solidified iron, successive allotropic transformation occurs from a $\delta$ phase, through a $\gamma$ phase, to an $\alpha$ phase and the amount of dissolved nitrogen varies as the temperature drops. This difference in nitrogen solubility can be utilized to form pores in solid iron by means of the nitrogen gas separated out in the $\gamma$ phase. This phenomenon also occurs in the same manner when nitrogen-inert gas mixture, hydrogen-nitrogen mixture, hydrogen-inert gas mixture, hydrogen-nitrogen-inert gas mixture or the like is used instead of nitrogen as the pressurizing gas, so that a similar porous iron material can be obtained. Furthermore, the similar phenomenon occurs when an iron alloy such as steel, copper or an alloy thereof, nickel or an alloy thereof, or any of the various metals listed above or an alloy thereof is used as the metal species, so that porous bodies of various metals can be produced by the same procedure.

Also, a certain correlation is generally seen between the gas atom concentration in a metal-gas system and the state of pore formation (pore distribution, pore size, etc.) in the manufacture of a porous metal body at a constant pressure. We will assume here that the gas-dissolved metal (metal-gas system) is cooled in a cylindrical mold from the circumferential surface direction, and that we are observing a cross section of the cylindrical metal body thus obtained. Here, if the cooling is carried out properly, substantially the same results will be obtained no matter where the cross section is located.

Figure 2:
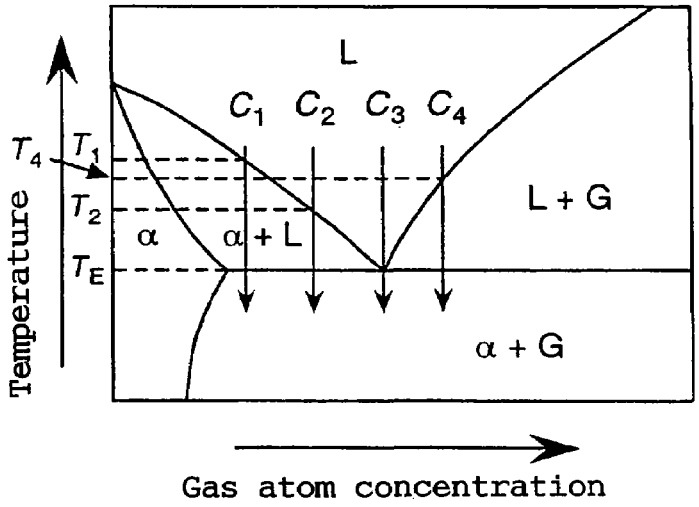
FIG. 2 is a phase diagram showing phase change in an iron-nitrogen system.
Figure 2:
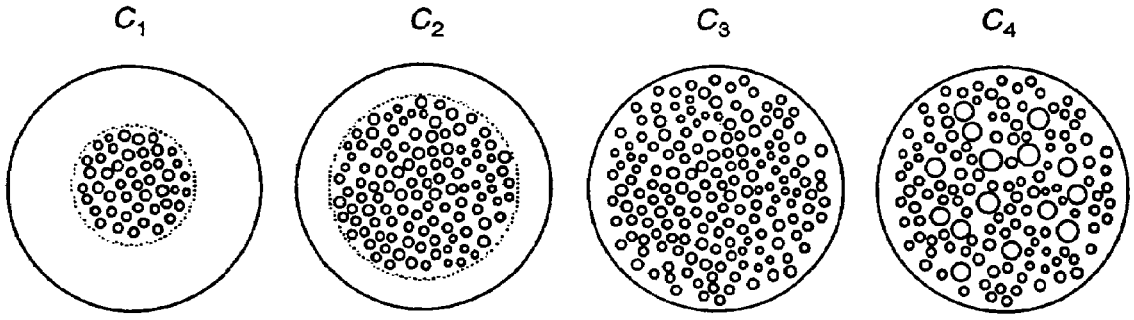

First, as shown in FIG. 2, if the gas atom concentration $C_1$ is considerably lower than the eutectic composition $C_3$, in the course of cooling from a temperature $T_1$ to $T_E$, a non-porous metal solid phase portion is formed in a certain thickness from the inner surface of the mold toward the center, and then in the course of cooling from the temperature $T_E$ to a lower temperature, a porous metal phase is formed in the middle region (see cross section $C_1$).

If the gas atom concentration $C_2$ is between the eutectic composition $C_3$ and $C_1$, in the course of cooling from a temperature $T_2$ to $T_E$, a non-porous metal solid phase portion is formed in a narrower width from the inner surface of the mold toward the center, and then in the course of cooling from the temperature $T_E$ to a lower temperature, a porous metal phase is formed in a broader middle region (see cross section $C_2$).

If the metal-gas system has the eutectic composition $C_3$, the metal begins to solidify at the temperature $T_E$ and pores are formed at the same time, so that non-porous metal solid phase portion is formed. The pore size is relatively uniform (see cross section $C_3$).

If the gas atom concentration $C_4$ is higher than a eutectic composition $C_3$, in the course of cooling from a temperature $T_4$ to $T_E$, large pores are formed in the liquid phase, and the metal begins to solidify at the temperature $T_E$. Smaller pores are formed in the course of cooling from the temperature $T_E$ to a lower temperature. Therefore, in this case a porous metal phase including pores of different sizes is formed, and no non-porous metal solid phase portion is formed (see cross section $C_4$).

Figure 5:
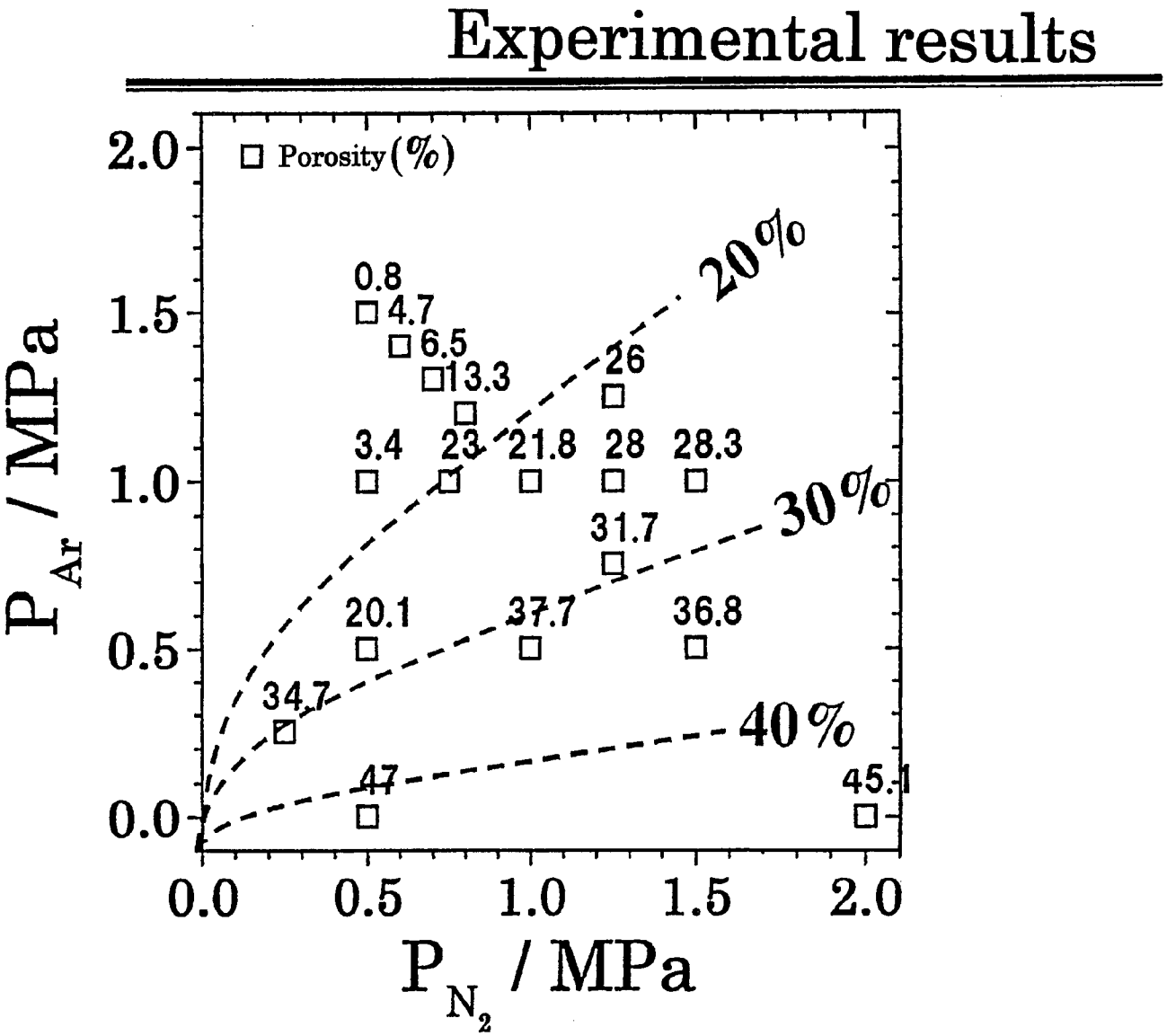
FIG. 5 is a graph showing the relationship between nitrogen/argon partial pressure ratio and porosity in porous iron materials obtained when pure iron (99.99%) is melted and cast under pressurization with a nitrogen-argon mixed gas with different partial pressures.

FIG. 5 is a graph showing an example of the change in porosity in porous pure iron (99.99%) manufactured under pressurization with a mixed gas of nitrogen and argon. As is clear from FIG. 5, when the argon gas pressure is constant, the porosity in the porous body increases as the nitrogen gas pressure increases. Conversely, when the nitrogen gas pressure is constant, the porosity in the porous metal body decreases as the argon gas pressure increases. As indicated by the three broken lines, the porosity in the porous body tends to increase as the gas pressure of the entire mixed gas increases.

Figure 6:
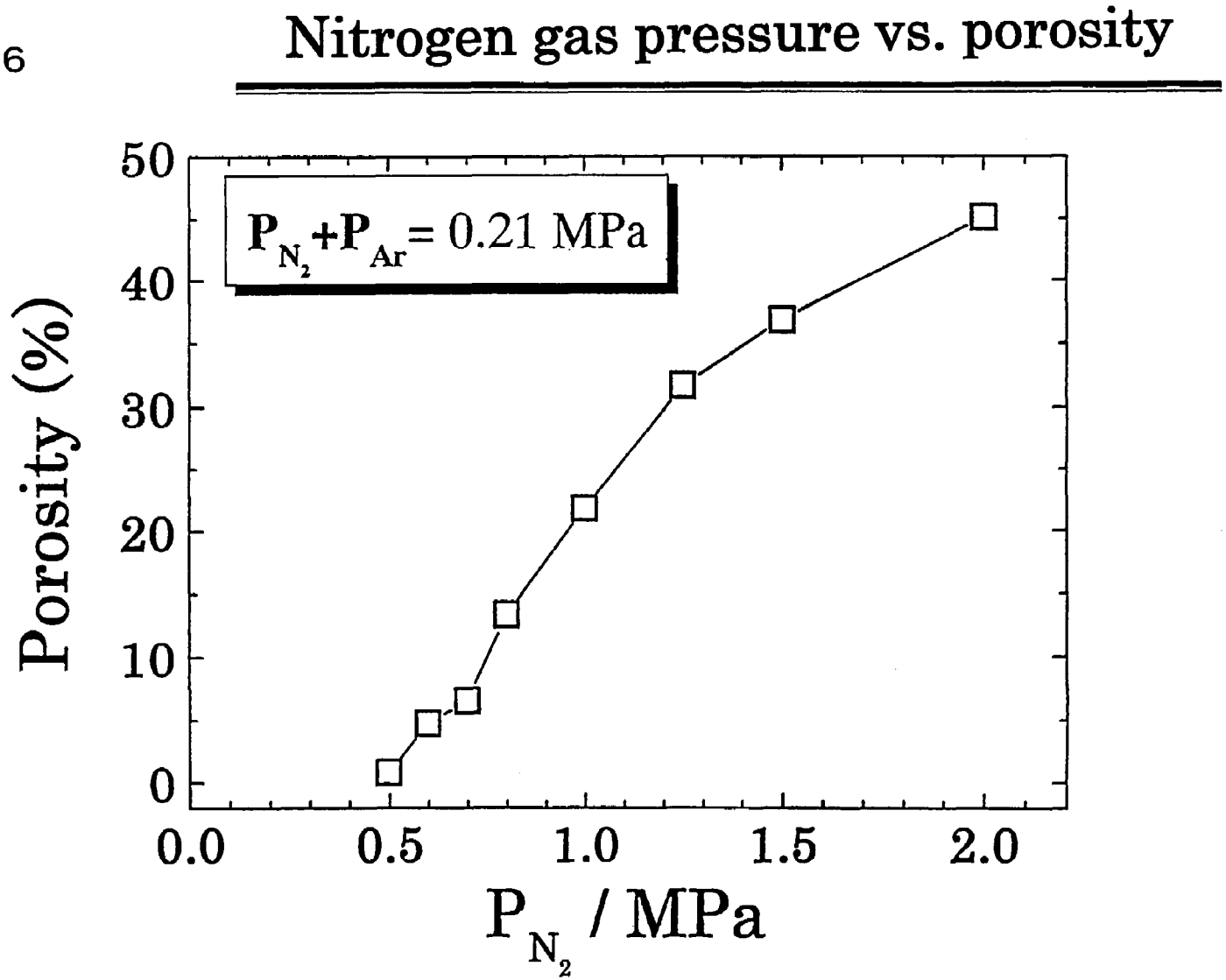
FIG. 6 is a graph showing the relationship between nitrogen partial pressure and porosity in porous iron materials obtained when pure iron (99.99%) is melted and cast under pressurization with a nitrogen-argon mixed gas with different partial pressures under constant total pressure of 2.1 MPa.

FIG. 6 is a graph showing an example of the change in porosity in porous pure iron (99.99%) manufactured under constant pressure pressurization (2.1 MPa) with nitrogen-argon mixed gas. As is clear from FIG. 6, under constant pressure conditions, the porosity in the porous body increases along with the increase in the nitrogen partial pressure. If FIGS. 5 and 6 are considered together, it is clear that nitrogen gas contributes greatly to an increase in the porosity in the porous metal body. Similar results were also obtained when nitrogen-helium mixed gas is used instead of nitrogen-argon mixed gas.

It is clear from the results shown in FIGS. 5 and 6 that the porosity of a porous metal body can be controlled by adjusting the composition of the pressurization atmosphere gas.

Figure 7:
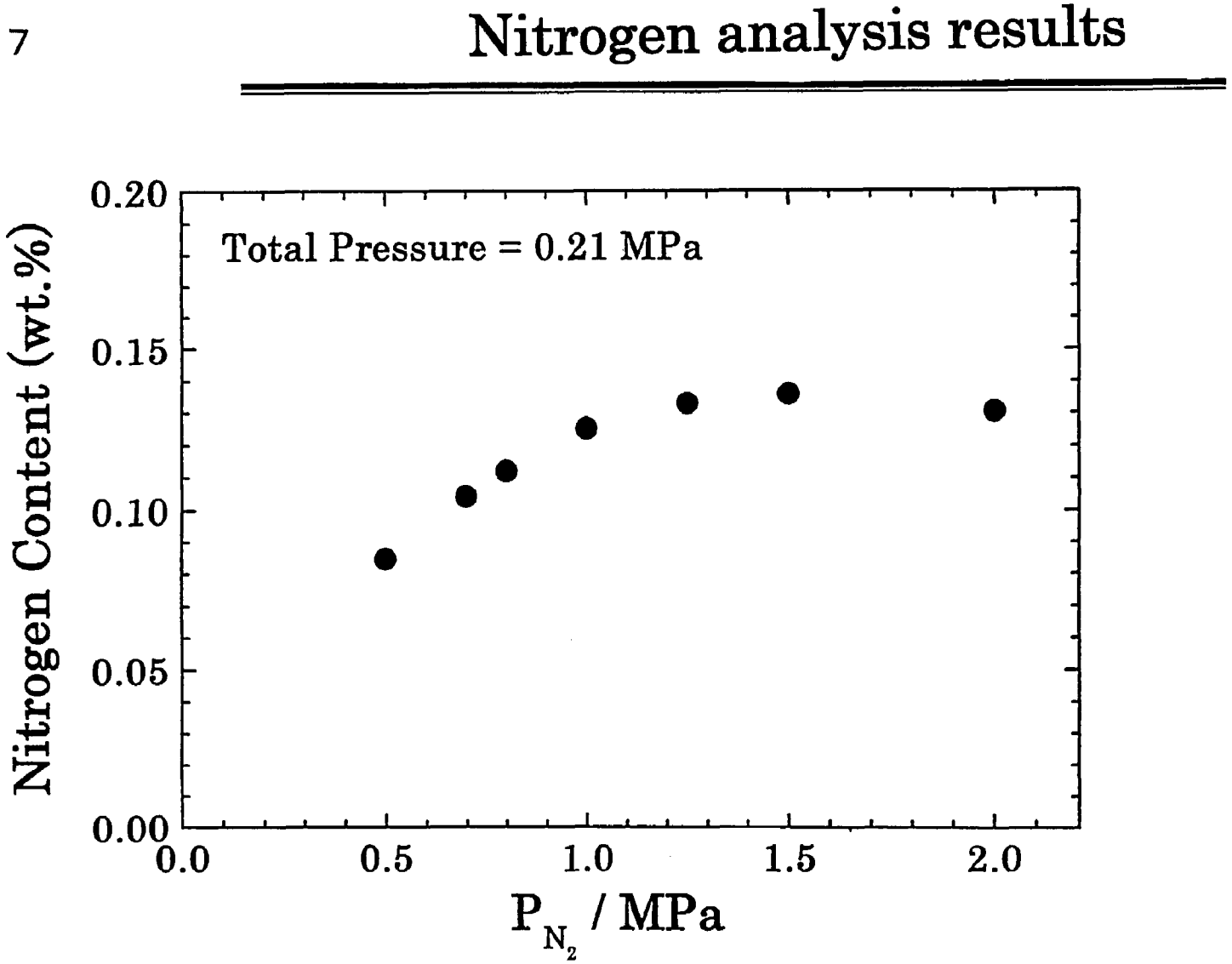
FIG. 7 is a graph showing the relationship between nitrogen partial pressure and nitrogen content in porous iron materials obtained when pure iron (99.99%) is melted and cast under pressurization with a nitrogen-argon mixed gas with different partial pressures under constant total pressure of 2.1 MPa.

FIG. 7 shows the nitrogen content in porous pure iron (99.99%) manufactured under constant pressure pressurization (2.1 MPa) with a nitrogen-argon mixed gas. The nitrogen content steadily rises along with the rise in nitrogen partial pressure, but saturates when the nitrogen partial pressure is about 1 MPa. The obtained porous pure iron has a high apparent nitrogen content, but the majority of this nitrogen is concentrated in an extremely thin surface-layer portion on the surface of the pores, and only a trace amount of $Fe_4N$ is contained and dispersed in the a phase in the interior of the pure iron. That is to say, the hardness of the resulting porous body is markedly improved, as if the entire surface, including the pore surfaces, had been subjected to nitriding treatment. This distinctive aspect of the entire porous body, in which only a trace amount of $Fe_4N$ is present in the interior even though a large quantity of nitrogen is contained in the porous body as a whole, is presumably attributable to the subtle changes in the amount of dissolved nitrogen due to the transition from the liquid phase to the solid phase ($\delta$ phase, $\gamma$ phase and $\alpha$ phase).

The porous metal body obtained with the present invention also has various other excellent characteristics (such as its strength, toughness, machinability, workability, weldability, vibration attenuation, acoustic attenuation, high specific surface area, etc.). For example, the porous metal material according to the present invention has a specific strength (strength/weight) which is about 20 to 30% higher than that of the raw metal material, and the Vickers hardness which is about three times higher.

The iron-based porous metal body obtained by the present invention can also be further hardened by hardening treatment to increase its Vickers hardness to about twice that prior to the hardening.

Figure 8:
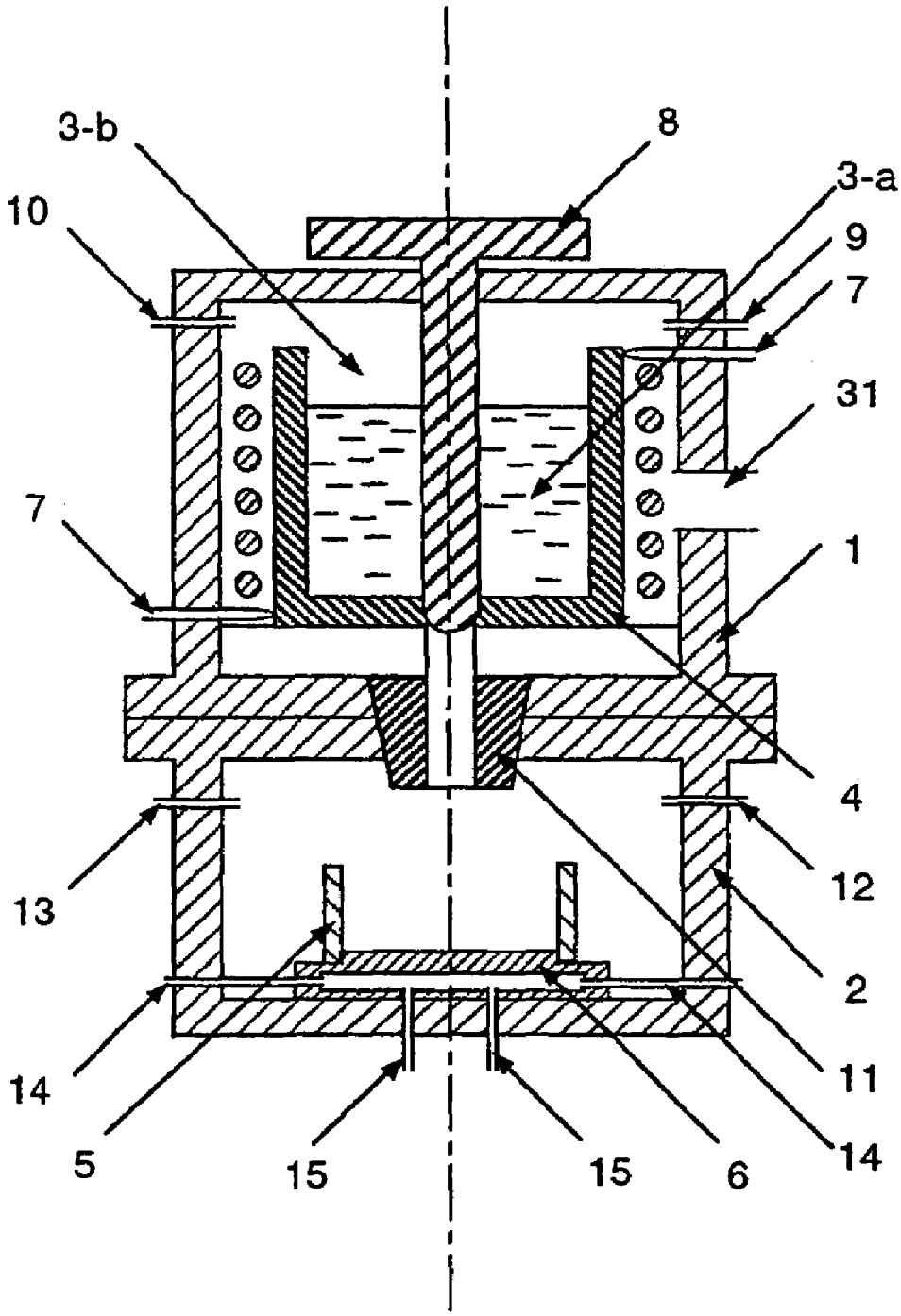
FIG. 8 is a cross section outlining the porous metal body producing apparatus used in the present invention.

FIG. 8 is a cross section showing an example of the apparatus used in the present invention to manufacture a porous metal body.

The apparatus shown in FIG. 8 has a raw metal material heating and melting section 1 and a molten metal cooling and solidifying section 2, which are the main constituents, disposed one above the other.

The raw metal material heating and melting section 1 comprises a metal melting tank 4, an inductive heating coil 7, a stopper 8, a degassing path 31, a gas introduction pipe 9, and a gas exhaust pipe 10. In step (1), the raw metal material is placed in the melting tank 4, and then the stopper 8 is placed in its closed position to seal off the melting tank 4, and a vacuum pump (not shown) is then actuated to purge the gas inside the melting tank 4 through the degassing path 31 and to achieve the desired reduced pressure condition. Electric power is then supplied to the inductive heating coil 7, and the raw metal material is heated according to a given heating profile under reduced pressure. This heating treatment under reduced pressure greatly reduces the amount of impurity gas components, such as oxygen, nitrogen and so forth in the raw metal material. As a result, the gas content in the porous metal body eventually obtained is also greatly reduced.

Then, a gas is introduced from the gas introduction pipe 9 into an upper space 3-*b* of the melting tank 4 while the impurity gas components released from the raw metal material are purged through the gas exhaust pipe 10 to the outside of the melting tank.

Figure 3:
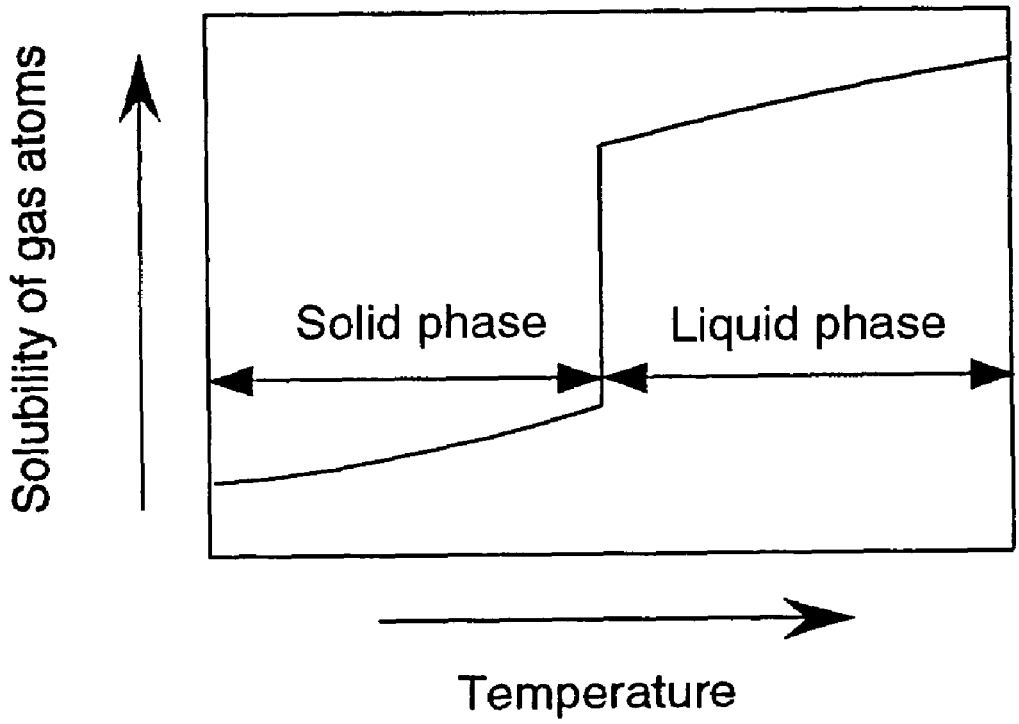
FIG. 3 is a conceptual diagram showing the gas-dissolving characteristics of the solid and liquid phases in the cooling and solidifying step of the molten metal in which gas has been dissolved.

In step (2), with the gas exhaust pipe 10 closed, a given gas is introduced from the gas introduction pipe 9 into the upper space 3-*b* of the melting tank 4, and the metal is melted by supplying electric power to the inductive heating coil 7 either while or after the inside of the melting tank 4 is pressurized to the specified pressure. The pressurizing gas in step (2) and the purging gas in step (1) may have the same or different compositions, but from the standpoints of simplifying the gas supply apparatus, facilitating gas-supply operation and so forth, it is preferable that the compositions are the same. By melting the metal under this pressurization conditions, a large quantity of gas is dissolved in the metal, as shown in FIG. 3 and FIG. 4.

Subsequently, the stopper 8 is lifted and the molten metal 3-*a* in which the gas has been dissolved is poured through a molten metal inlet 11 into a mold 5 disposed at the bottom of the molten metal cooling and solidifying section 2, forming a porous metal body. Before the molten metal is poured in, a given gas is introduced from a gas supply pipe 12 into the molten metal cooling and solidifying section 2 so as to maintain the interior thereof at the specified pressure. The gas pressure inside the molten metal cooling and solidifying section 2 can be easily controlled by suitably opening or closing the gas supply pipe 12 and a gas exhaust pipe 13. Meanwhile, the cooling rate of the molten metal inside the mold 5, which is equipped with a cooling mechanism 6, can be controlled by the amount of a cooling water that is supplied from a pipe 14 for introducing water or like coolant (since water is usually used, this will hereinafter be referred to as "water") and discharged from a cooling water discharge pipe 15.

Thus, by cooling the molten metal poured in the mold 5 from the bottom by means of the cooling mechanism 6 while controlling the gas pressure inside the melted metal cooling and solidifying section 2, numerous bubbles originating from the gas dissolved in the liquid phase portion are produced near the interface between the liquid phase on the top and the solid phase on the bottom, and these bubbles create pores in the solid phase. As a result, a porous metal material having the given pore shape, porosity and so forth is obtained.

Figure 9:
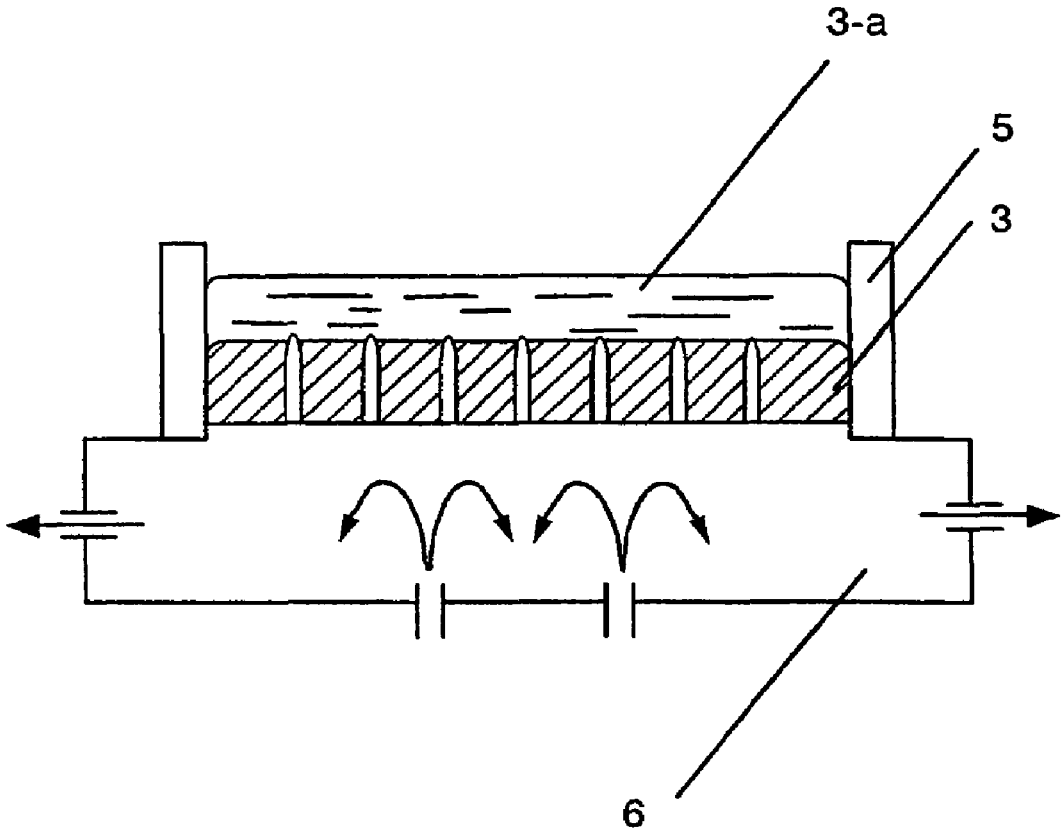
FIG. 9 is a figure outlining a mold equipped with a cooling mechanism at the bottom.

FIG. 9 is a drawing schematically illustrating an example of the mold 5 and its cooling mechanism 6 used in the apparatus shown in FIG. 8. In this embodiment, the cooling mechanism 6 itself serves as the bottom of the mold 5. In this case, cooling water is supplied from the bottom of the cooling mechanism 6 which is in contact with the molten metal 3-*a*, thereby rapidly cooling the molten metal. Although FIG. 6 shows the state when vertical pores are being formed in the course of cooling the molten metal, a porous metal body 3 having pores extending vertically from bottom to top can be eventually formed as the metal solidifies.

Figure 10:
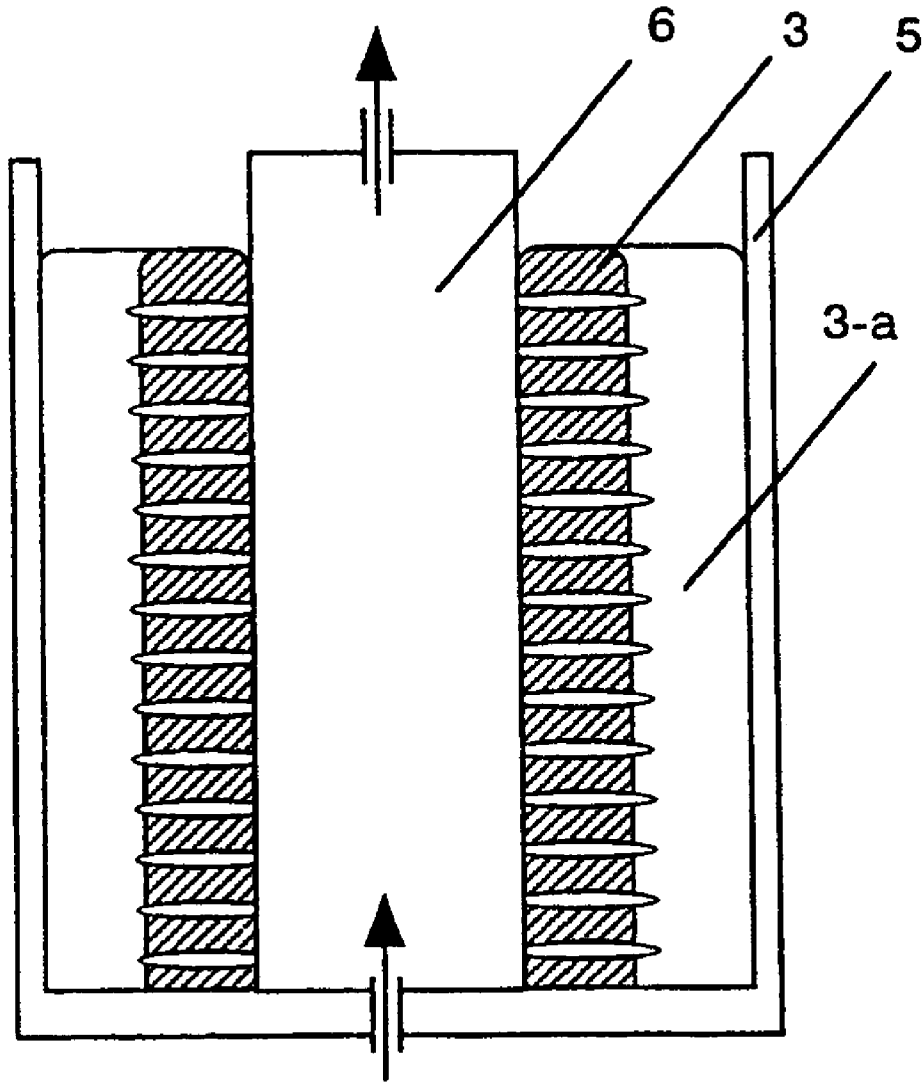
FIG. 10 is a figure outlining a cylindrical mold equipped with a cooling mechanism on its inner surface.

FIG. 10 is a simplified diagram showing another example of the mold 5 and its cooling mechanism 6 used in the apparatus shown in FIG. 8. In this embodiment, the cooling mechanism 6 is disposed in the center of the mold 5, and the molten metal 3-*a* is poured into the cylindrical space in between the two. Although FIG. 10 shows the state when lateral pores are being formed in the course of cooling the molten metal, a porous metal body 3 having pores extending laterally from the inside to the outside of the cylinder can be eventually formed.

Figure 11:
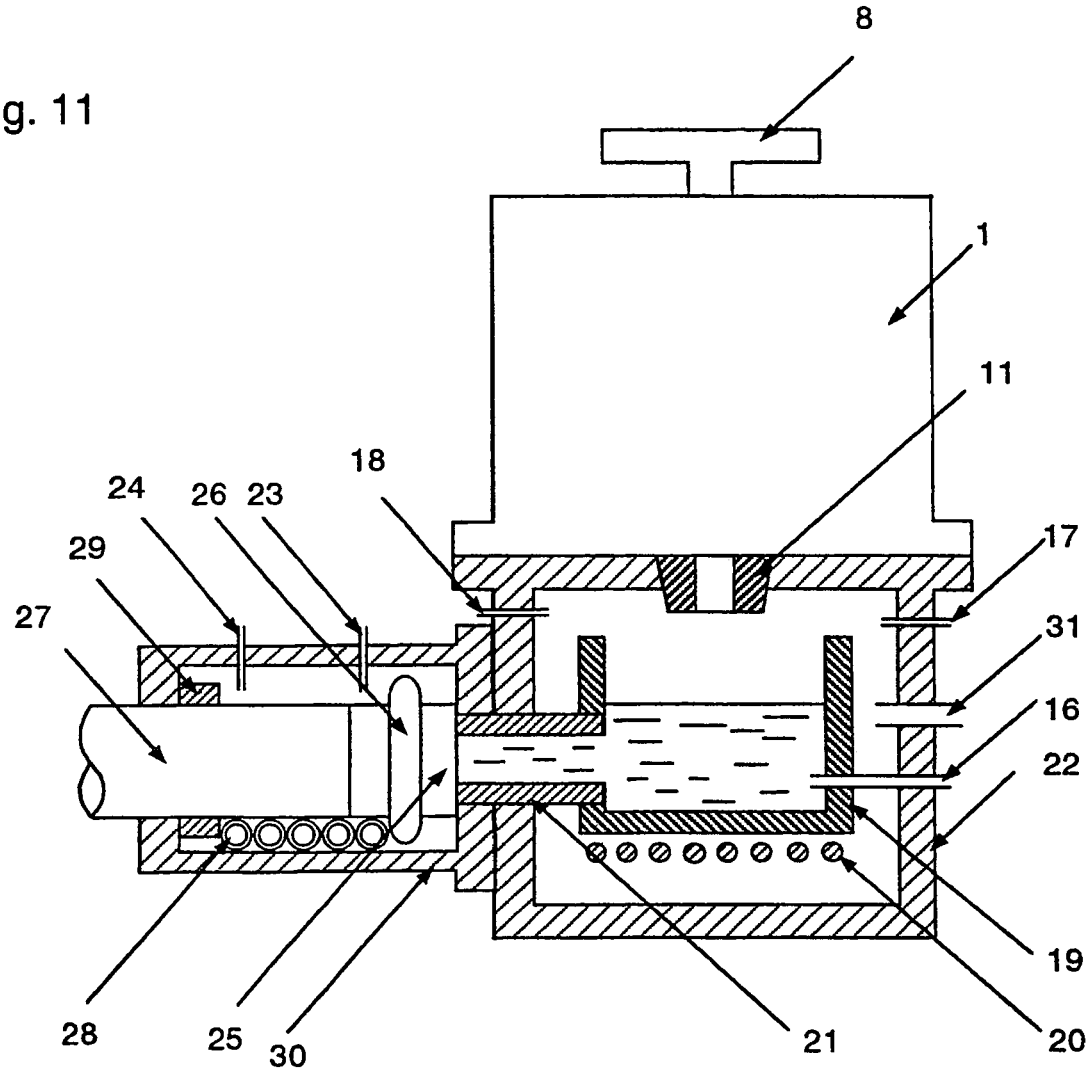
FIG. 11 is a cross section outlining the apparatus for producing a porous metal body by continuous casting method used in the present invention.

FIG. 11 schematically illustrates an example of a porous metal body producing apparatus featuring continuous casting method.

The apparatus shown in FIG. 11 has a raw metal material heating and melting section 1 and a molten metal holding section 22 disposed one above the other, and a continuous casting apparatus is linked in the lateral direction to the molten metal holding section 22. The degassing and melting of the raw metal material in the raw metal material heating and melting section 1 are performed in the same manner as with the apparatus shown in FIG. 8.

Next, the stopper 8 is lifted and the molten metal 3-*a* in which the gas has been dissolved is poured through a molten metal inlet 11 into a melt holding container 19 located at the bottom of the molten metal holding section 22. Before the molten metal is poured into the melt holding container 19, a vacuum pump (not shown) is actuated to purge the gas through the degassing pipe 31 to thereby reduce the pressure inside the molten metal holding section 22, after which a given gas is introduced through a gas supply pipe 17 to maintain the inside at a given pressure. The gas pressure inside the molten metal holding section 22 can be easily controlled by suitably opening or closing the gas supply pipe 17 and a gas exhaust pipe 18. The molten metal that has been poured into the melt holding container 19 is maintained at a given temperature by a heater 20.

Then, the molten metal that has been pressurized by the gas supplied from a gas injection pipe 16 enters a mold 21 and is continuously cast, eventually forming a long porous metal body. The behavior of the gas at the liquid phase/solid phase interface in the course of the solidification of the molten metal, how the pores are formed in the metal body, and so forth are substantially the same as with the apparatus shown in FIG. 8. The main constituents of the continuous casting apparatus include the portion of the mold 21 surrounded by a cooling mechanism 25 (the liquid phase/solid phase interface is formed in this portion), an auxiliary cooling mechanism 26 which is provided optionally, a guide spindle 27 which is contacted with the end of the solidified porous metal body, rollers 28, and so forth. The continuous casting apparatus is provided inside a sealed structure 30 in order to prevent the oxidation of the porous metal body at high temperatures, to protect the cooling mechanism, and so on. The sealed structure 30 is equipped with an airtight ring 29, an inert gas injection pipe 23, and an inert gas exhaust pipe 24 in order to adjust the inert gas pressure inside this structure. In FIG. 11, at the point when the end of the porous metal body guided by the guide spindle 27 moving to the left reaches the position where the airtight ring 29 is installed, the airtight ring 29 moves inward so as to come into close contact with the outer circumferential surface of the porous metal body. Then, the guide spindle 27 is taken out of the sealed structure 30, and the porous metal body is then successively withdrawn out of the sealed structure 30. Thus, a long porous metal body is obtained.

Figure 12:
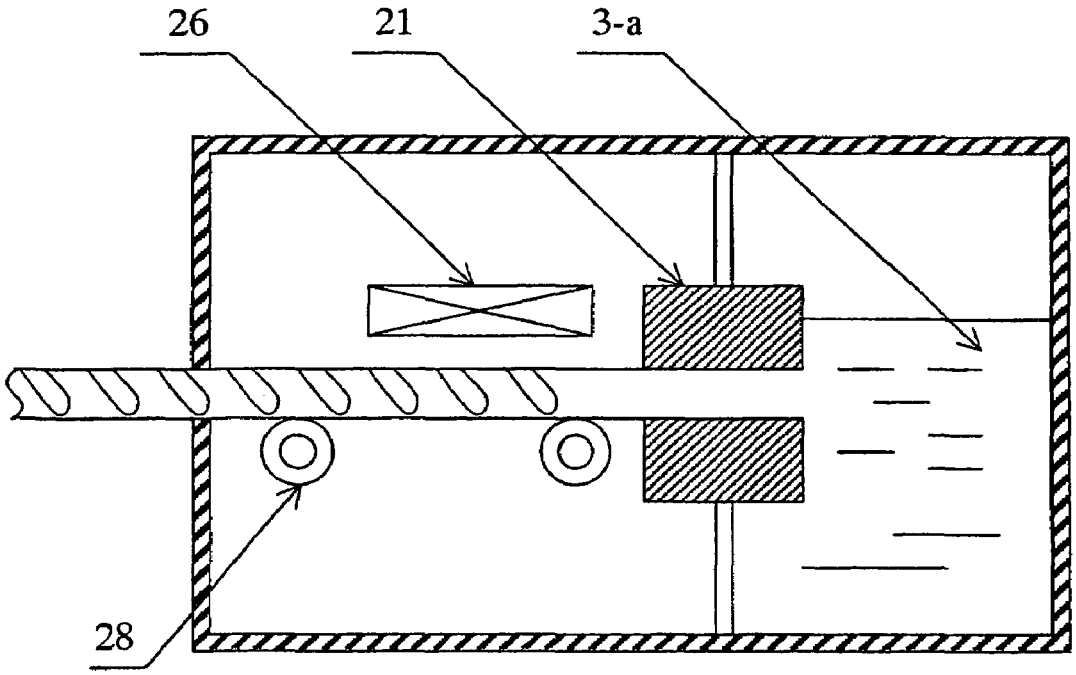
FIG. 12 is a figure outlining an apparatus for producing a rod- or plate-shaped porous metal material by continuous casting method.

FIG. 12 is a schematic diagram showing another example of the continuous casting apparatus used for producing a long porous metal body. In FIG. 12, the mechanical elements related to degassing and melting the raw metal material are left out. With this apparatus, in the course of solidification, the liquid phase/solid phase interface of the metal is formed inclined to the movement direction of the metal body due to the effect of the shape and the position of the cooling mechanism 26, the cooling rate, the gas pressure, and so forth, so that a porous metal body having the inclined pores shown in the drawing is obtained. The shape of the porous metal body can be any desired shape, such as cylindrical, linear, tabular, prismatic, etc., corresponding to the internal surface shape of the mold.

Figure 13:
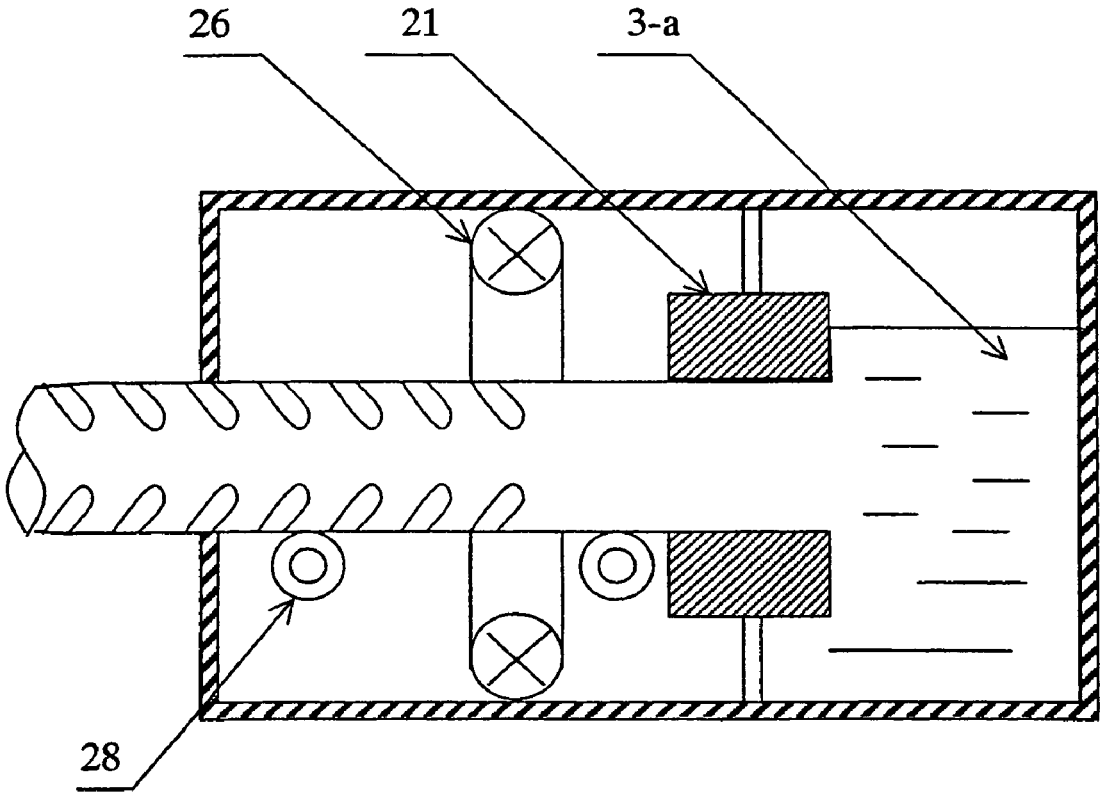
FIG. 13 is a cross section outlining an apparatus for producing a rod- or plate-shaped porous metal material by continuous casting method.

FIG. 13 is a schematic diagram showing yet another example of the continuous casting apparatus used for producing a rod-shaped or wire-shaped porous metal body. Again in FIG. 13, the mechanical elements related to degassing and melting the raw metal material are left out. With this apparatus as well, in the course of solidification, the structure and the location of the cooling mechanism 26, the cooling rate, the gas pressure, and so forth are adjusted, and the liquid phase/solid phase interface in the metal is controlled with respect to the movement direction of the metal body, producing a porous metal body having pores of the shape shown in the drawing.

Figure 14:
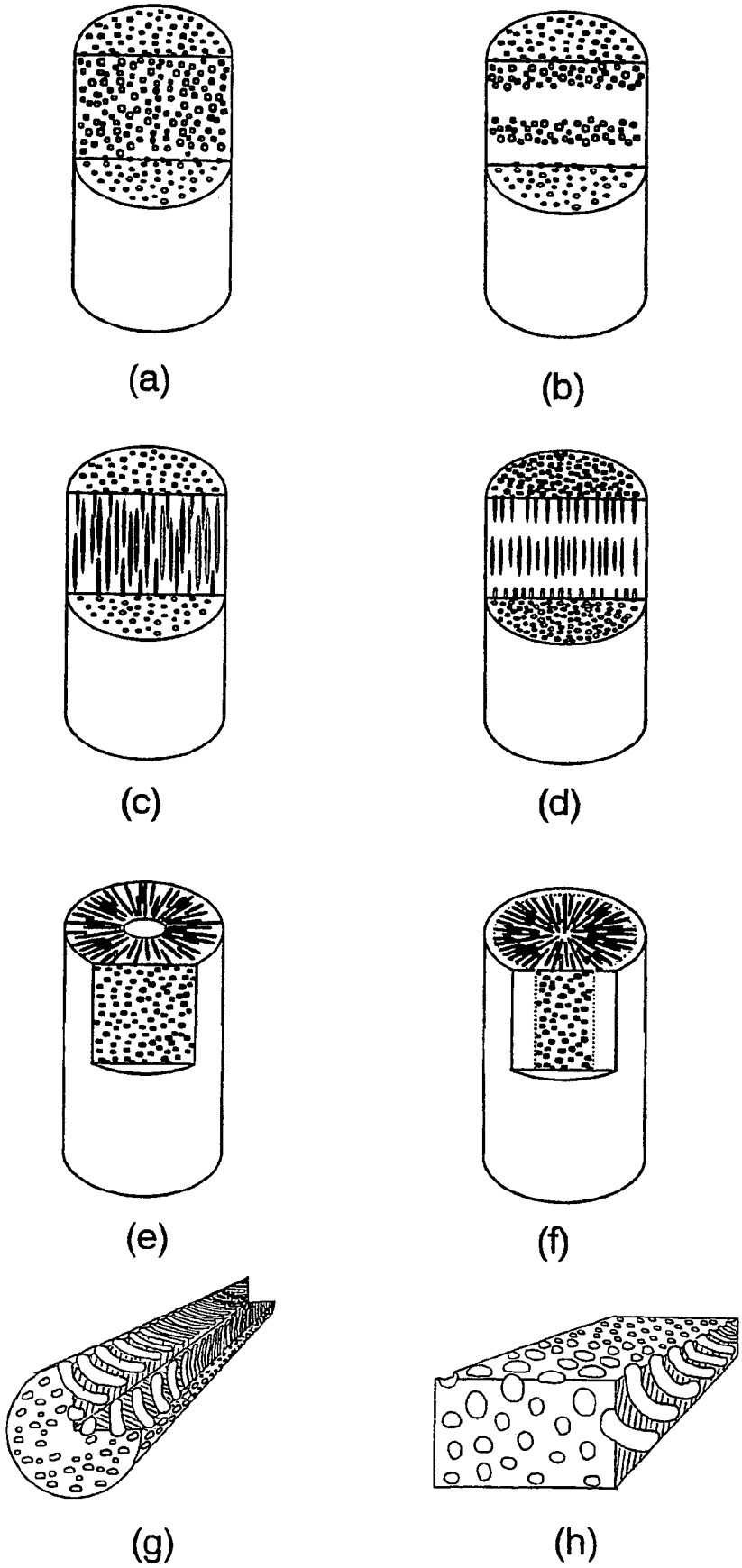
FIG. 14 (*a*) to FIG. 14 (*h*) are partially cut-away oblique views of porous metal materials in various forms which can be manufactured by the method of the present invention.

FIG. 14 (*a*) to FIG. 14 (*h*) are schematic oblique views, with partial cut-aways, of the porous metal body manufactured by the method of the present invention by continuous casting process. For example, the porous metal body shown in FIG. 14 (*a*) is a cylindrical metal body having a cross section corresponding to $C_3$ in FIG. 2, and can be manufactured when the liquid phase/solid phase interface in the metal is moved at a constant movement rate along the transverse cross section of the cylinder from one end to the other. The cylindrical porous metal body shown in FIG. 14 (*b*) is a cylindrical metal body having a cross section corresponding to $C_3$ in FIG. 2, and can be manufactured when the movement rate of the liquid phase/solid phase interface in the metal is changed intermittently along the transverse cross section of the cylinder from one end to the other. The cylindrical porous metal body shown in FIG. 14 (*c*) is a cylindrical metal body having a cross section corresponding to $C_3$ in FIG. 2, and can be manufactured when the gas pressure is changed intermittently while the movement rate of the liquid phase/solid phase interface in the metal is constant along the transverse cross section of the cylinder from one end to the other. The cylindrical porous metal body shown in FIG. 14 (*d*) is a cylindrical metal body having a cross section corresponding to $C_3$ in FIG. 2, and can be manufactured when the gas pressure and the movement rate of the liquid phase/solid phase interface in the metal along the transverse cross section of the cylinder from one end to the other are changed intermittently. As shown in FIG. 10, the cylindrical porous metal body shown in FIG. 14 (*e*) can be manufactured when the cooling mechanism 6 is located in the center of the mold and the liquid phase/solid phase interface in the metal is moved in the transverse cross sectional direction from the center of the cylinder toward the peripheral portion. The cylindrical porous metal body shown in FIG. 14 (*f*) can be manufactured when the cooling mechanism is located around the peripheral portion of the cylindrical mold and the liquid phase/solid phase interface in the metal is moved at a constant rate in the transverse cross sectional direction from the peripheral portion toward the center of the cylinder. In this case, a ring portion in which no pores are present can be formed around the periphery by performing the initial cooling rapidly. The cylindrical porous metal body shown in FIG. 14 (*g*) can be manufactured by the procedure shown in FIG. 1. The porous metal body shown in FIG. 14 (*h*), which has a rectangular cross section, can be manufactured by the procedure shown in FIG. 11 with using a mold having a rectangular inner surface.

INDUSTRIAL APPLICABILITY

According to the present invention, it is possible to produce a porous metal material with a pore shape and size, porosity, and so on controlled by an easy method using simple equipment.

According to the present invention, it is possible to manufacture a porous metal material of any shape desired.

When the present invention is implemented by a continuous casting method, large and long porous metal materials can be manufactured.

According to the present invention, it is possible to remarkably reduce the content of impurity components in the resulting porous metal body as compared to the raw metal material. For instance, it is possible to reduce the oxygen content to 1/20 or less, and to reduce the nitrogen content to 1/6 or less.

In the present invention, when iron or an iron alloy is used as the raw metal material, and nitrogen is used as the pressurizing gas component, a nitriding phase is formed on all surfaces including the internal surfaces of the pores, resulting in a marked increase in hardness.

The porous metal material obtained according to the present invention is lightweight, has high specific strength (strength/weight), and has excellent machinability, weldability and so forth.

Also, the porous metal material according to the present invention can form a novel composite material that exhibits distinctive performance by filling its pore portions with another material or supporting another material in its pore portion. As a specific example of such a composite material, a catalyst whose carrier is a porous metal body instead of a conventional honeycomb carrier (such as an exhaust gas treatment catalyst for automobiles and so on, a deodorizing catalyst, etc.) would be exemplified.

In the present invention, the safety of the operations can be greatly improved if nitrogen, argon, helium or other such nonflammable gas is used as the pressurizing gas.

Because of its unique structure and excellent characteristics, the porous metal body according to the present invention can be utilized in a wide range of fields. Examples of such fields include hydrogen storage materials, vibration-proof materials, shock absorbing materials, electromagnetic shielding materials, parts and structural materials in various structures (engine parts for vehicles such as automobiles, ships, airplanes and so forth, ceramics supports for rocket and jet engines, lightweight panels for space equipment, machine tool parts, etc.), medical device materials (such as stent materials, etc.), heat exchange materials, sound insulation materials, gas/liquid separation materials, lightweight structural material parts, water and gas purification filters, self-lubricating bearing materials, gas blowing materials in gas/liquid reactions, and so forth. The porous metal body according to the present invention is not limited to the above applications, and can be utilized in various other applications as well.

BEST MODE FOR CARRYING OUT THE INVENTION

The best modes (examples) of the present invention will be given below to further clarify the characteristics of the present invention. The present invention is not limited to the following examples, and it goes without saying that various alterations, modifications, changes, etc., can be made within the scope of the present invention.

EXAMPLE 1

A porous copper material was manufactured by using the apparatus shown in FIG. 8.

More specifically, the copper raw material (99.99% purity) was maintained for 0.1 hour at 1250° C. and $5\times10^{-2}$ Torr, and then melted for 0.5 hour at 1250° C. under an atmosphere of one of the pressurizing gases which will be described in detail below. Then, under the same pressurization conditions, the molten copper having the gas as dissolved therein was poured into a cylindrical mold (100 mm tall, 30 mm inside diameter) and solidified from the bottom to the top by means of a water cooling mechanism provided at the bottom of the mold, yielding a porous copper cylinder with the structure shown in FIG. 14 (*c*).

Pressurizing Atmosphere Gas (Gauge Pressure)

(a) 0.2 MPa $H_2$+0.6 MPa Ar (b) 0.4 MPa $H_2$+0.4 MPa Ar (c) 0.6 MPa $H_2$+0.2 MPa Ar (d) 0.8 MPa $H_2$

Figure 15:
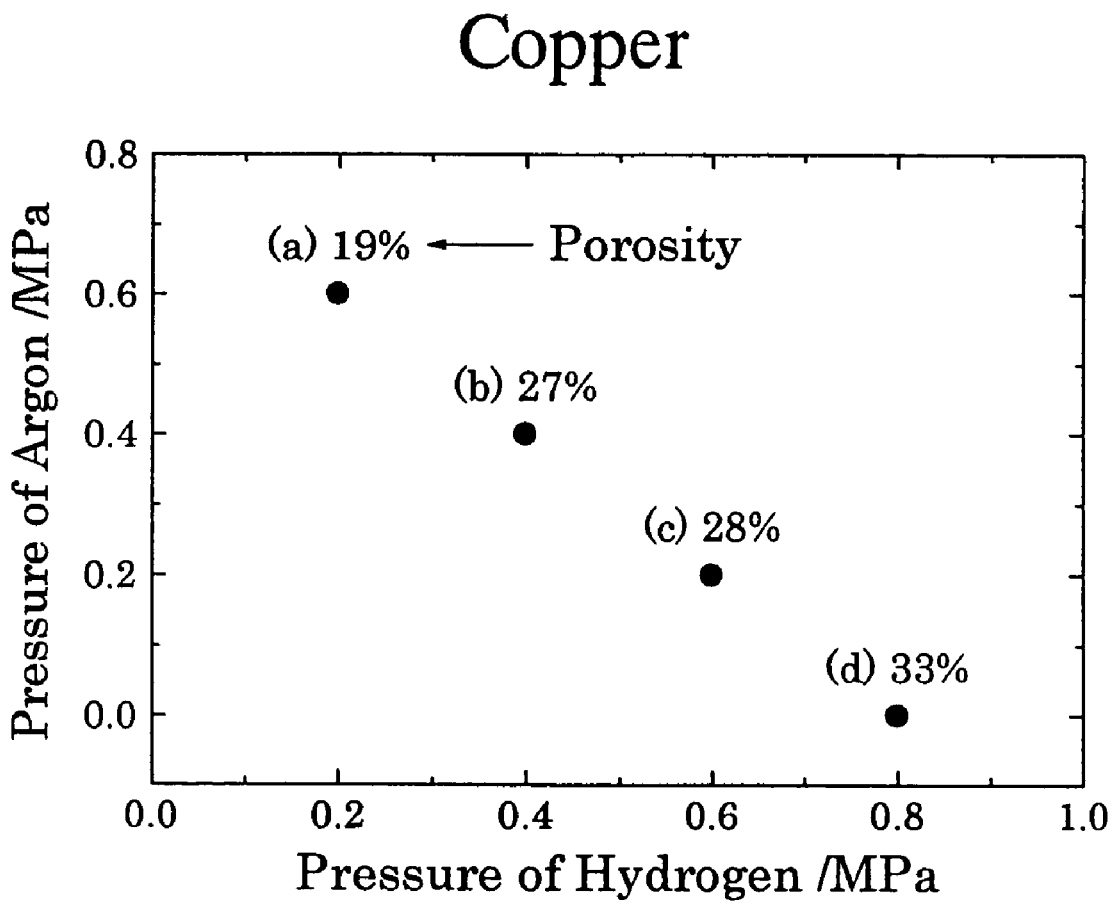
FIG. 15 is a graph showing the relationship between partial gas pressure ratio and porosity for four different porous copper materials obtained by melting at 1250° C. under pressurization of 0.8 MPa with hydrogen-argon mixed gas.

FIG. 15 shows the porosity each of the four different porous copper cylinders (a) to (d) obtained. It is clear from the results shown in FIG. 15 that under a constant pressure pressurization condition, the porosity increases as the hydrogen partial pressure rises.

Figure 16:
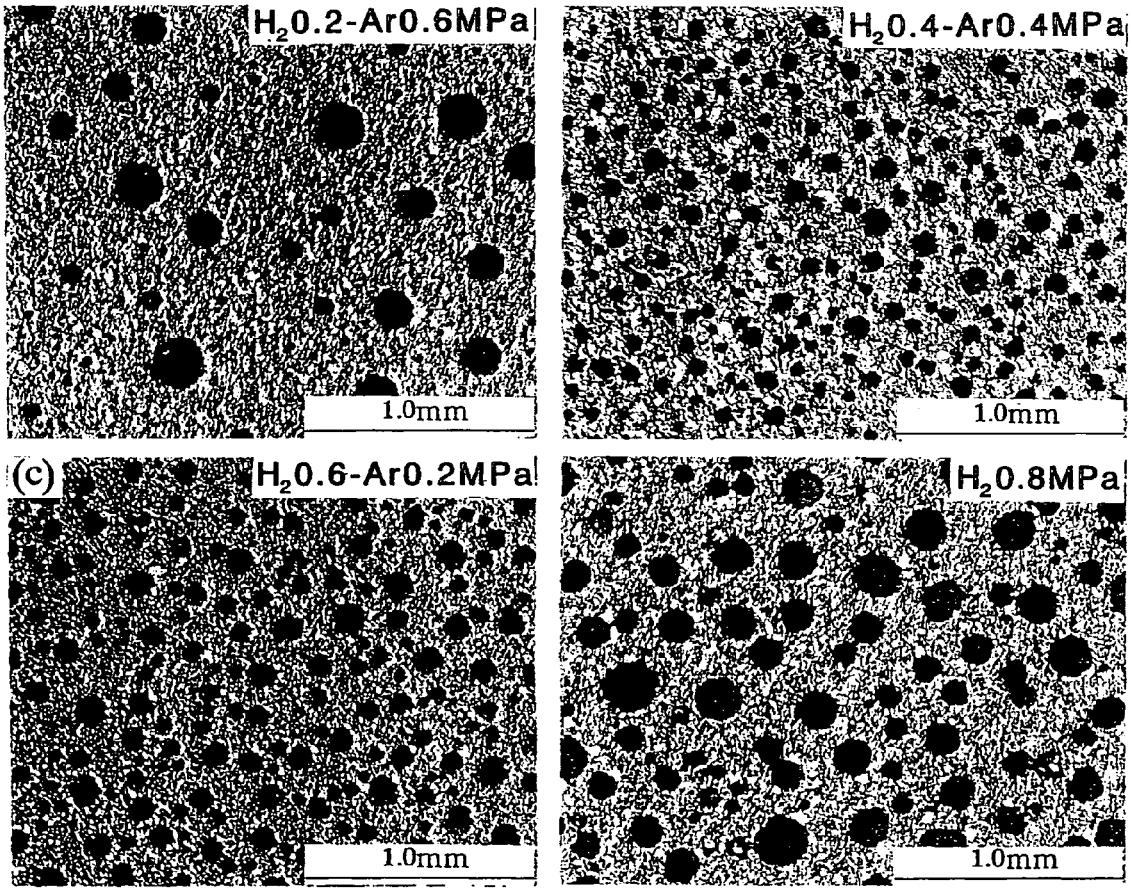
FIG. 16 (*a*) to FIG. 16 (*d*) are electronically processed images (corresponding to optical micrographs) showing the pore distribution state of four different porous copper materials obtained by melting at 1250° C. under pressurization of 0.8 MPa with hydrogen-argon mixed gas.

FIG. 16 (*a*) to FIG. 16 (*d*) are electronically processed images (corresponding to optical micrographs) showing a portion of the transverse cross section each of the above-mentioned four different porous copper cylinders (a) to (d). These show that the pore size can be varied by adjusting the argon/hydrogen partial pressure ratio.

Figure 17:
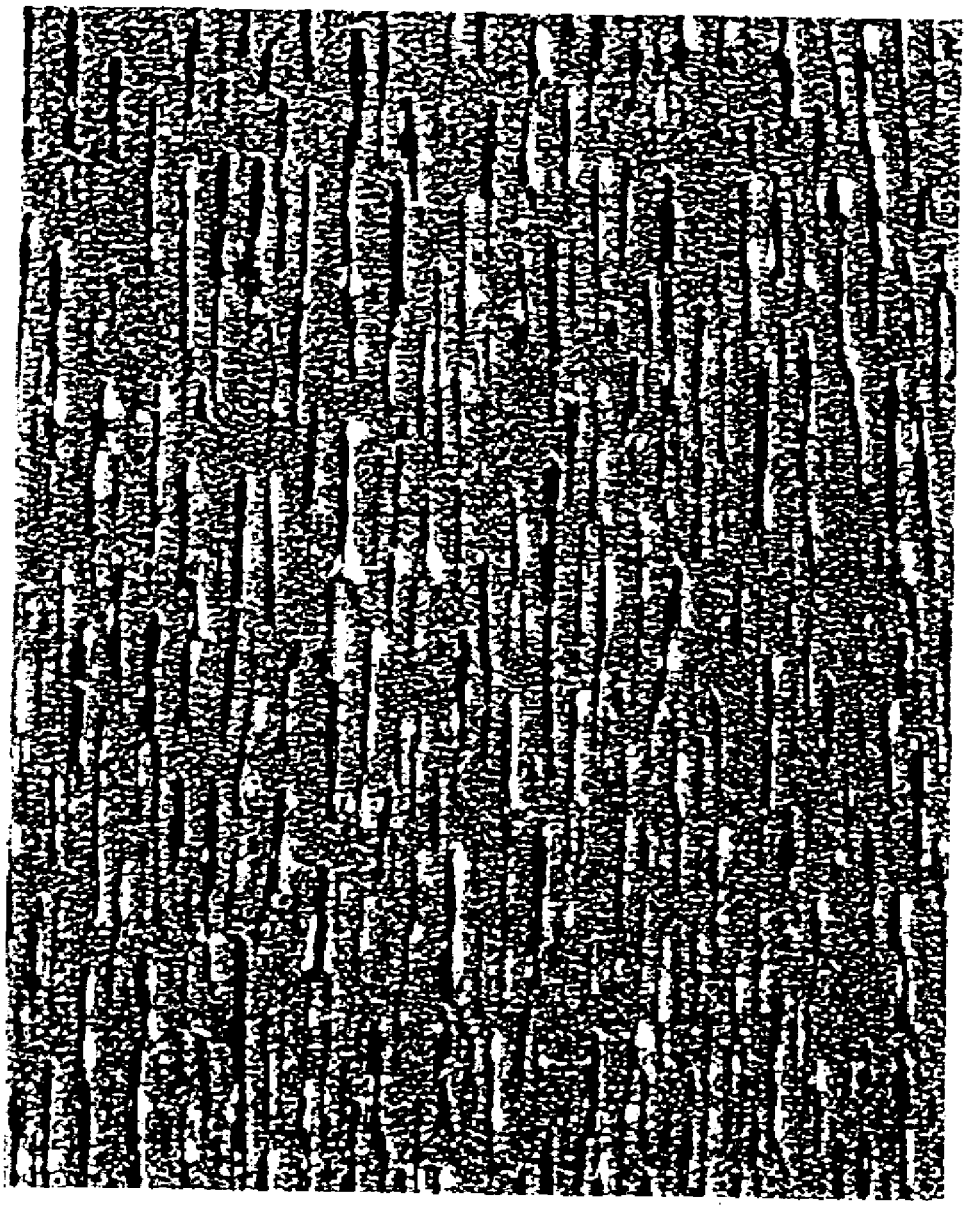
FIG. 17 is an electronically processed image (corresponding to a 12.5-power optical micrograph) illustrating a vertical cross section of a cylindrical porous copper material having a shape corresponding to FIG. 14 (*c*).

FIG. 17 is an electronically processed image (corresponding to an optical micrograph) illustrating a portion of a vertical cross section of the porous copper cylinder (c) obtained above. It is clear that elongated pores aligned vertically have been formed in a regular pattern.

The copper raw material contained about 157 ppm oxygen and 13 ppm nitrogen, whereas the oxygen and nitrogen contents in the copper porous body had dropped to 7 ppm and 2 ppm, respectively.

EXAMPLE 2

A porous iron material was manufactured by using the apparatus schematically shown in FIG. 8.

More specifically, iron raw material (99.99% purity) was maintained for 0.1 hour at 1800° C. and $5\times10^{-2}$ Torr, and then melted for 0.5 hour at 1650° C. under an atmosphere of one of the pressurizing gases described in detail below. Then, under the same pressurization conditions, the molten iron having the gas as dissolved therein was poured into a cylindrical mold (100 mm tall, 30 mm inside diameter) and solidified from the bottom to the top by means of a water cooling mechanism provided at the bottom of the mold, giving a porous iron cylinder with the structure shown in FIG. 14 (*a*).

Pressurizing Atmosphere Gas (Gauge Pressure)

(a) 0.3 MPa $N_2$+1.2 MPa He (b) 1.0 MPa $N_2$+1.0 MPa He (c) 1.0 MPa $N_2$+0.5 MPa He (d) 1.5 MPa $N_2$+0.5 MPa He

Figure 18:
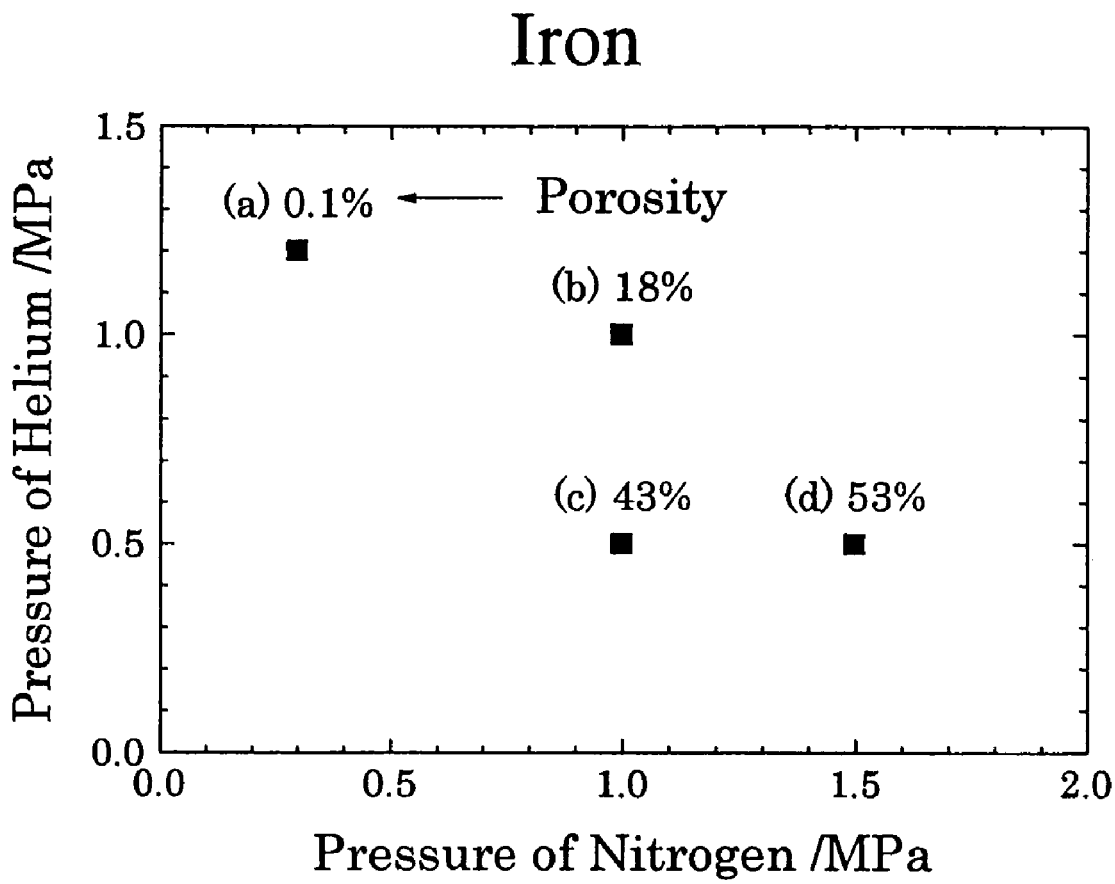
FIG. 18 is a graph showing the relationship between partial gas pressure ratio and porosity of the porous iron materials obtained by melting at 1650° C. under pressurization of 1.5 MPa or 2.0 MPa with nitrogen-helium mixed gas.

FIG. 18 shows the porosity each of the four different porous iron cylinders (a) to (d) obtained. It is clear from the result shown in FIG. 18 that under the pressurization condition of a constant pressure, porosity can be controlled by adjusting the nitrogen and helium partial pressures.

Figure 19:
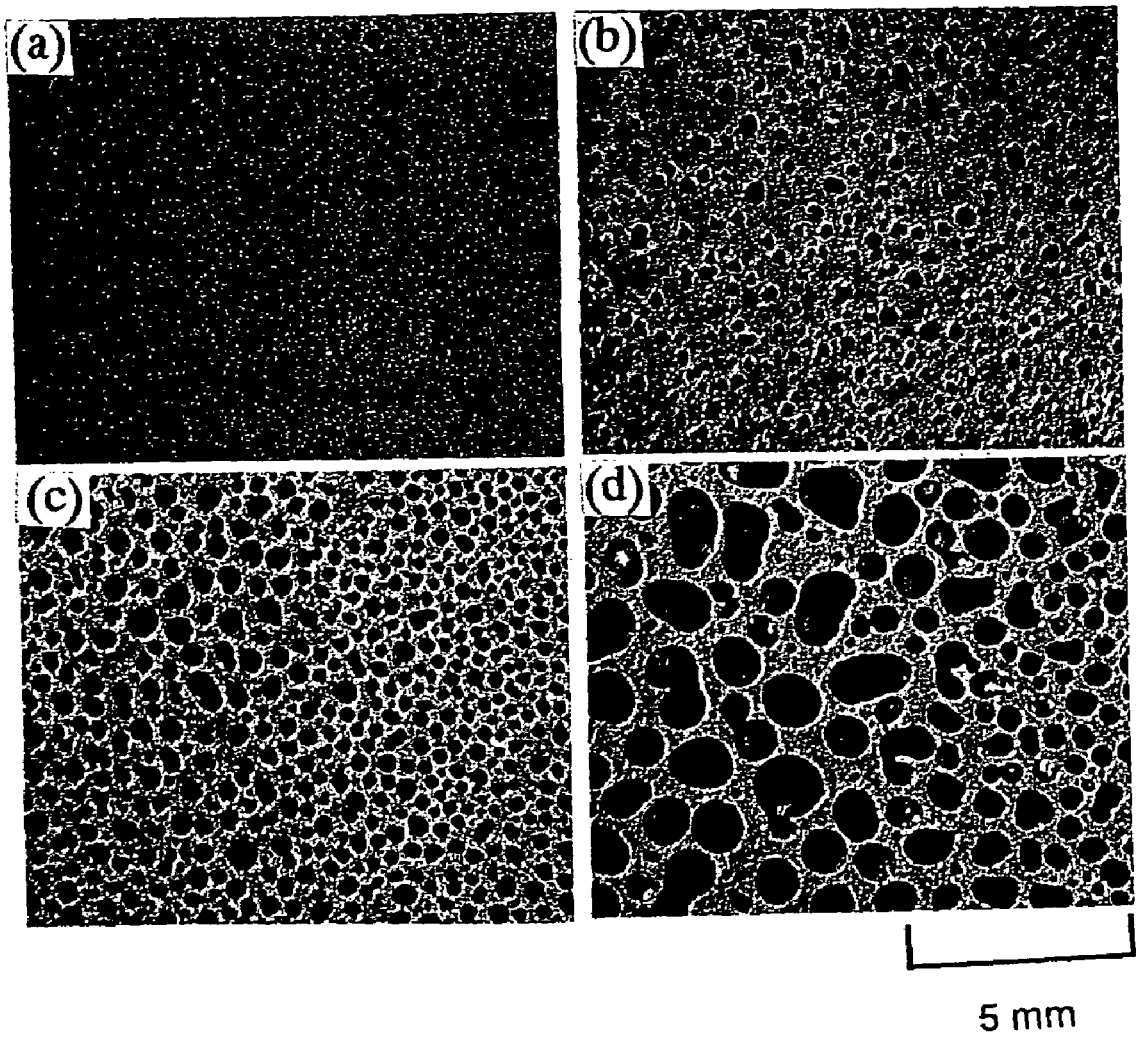
FIG. 19 (*a*) to FIG. 19 (*d*) are electronically processed images (corresponding to optical micrographs) illustrating the pore distribution state of four different porous ordinary steel materials obtained by melting at 1650° C. under pressurization with four different nitrogen-helium mixed gases with various partial gas pressure ratios.

FIG. 19 (*a*) to FIG. 19 (*d*) are electronically processed images (corresponding to optical micrographs) showing a portion of the transverse cross section each of the above-mentioned four different porous iron cylinders (a) to (d). These show that the pore size can be varied by adjusting the argon/hydrogen partial pressure ratio.

The porous iron materials obtained were heated to about 1000° C., and then plunged into water to conduct hardening, with the result that the Vickers hardness thereof increased about 2.5- to 3-fold.

EXAMPLE 3

A porous nickel material was manufactured by using the apparatus schematically shown in FIG. 8.

More specifically, the nickel raw material (99.99% purity) was maintained for 0.1 hour at 1600° C. and $5\times10^{-2}$ Torr, and then melted for 0.5 hour at 1600° C. under a pressurizing gas atmosphere (0.6 MPa $N_2$+0.2 MPa Ar). Then, under the same pressurization conditions, the molten nickel having the gas as dissolved therein was poured into a cylindrical mold (100 mm tall, 30 mm inside diameter) and solidified from the bottom to the top by means of a water cooling mechanism provided at the bottom of the mold, giving a porous nickel cylinder with the structure shown in FIG. 14 (*a*).

Figure 20:
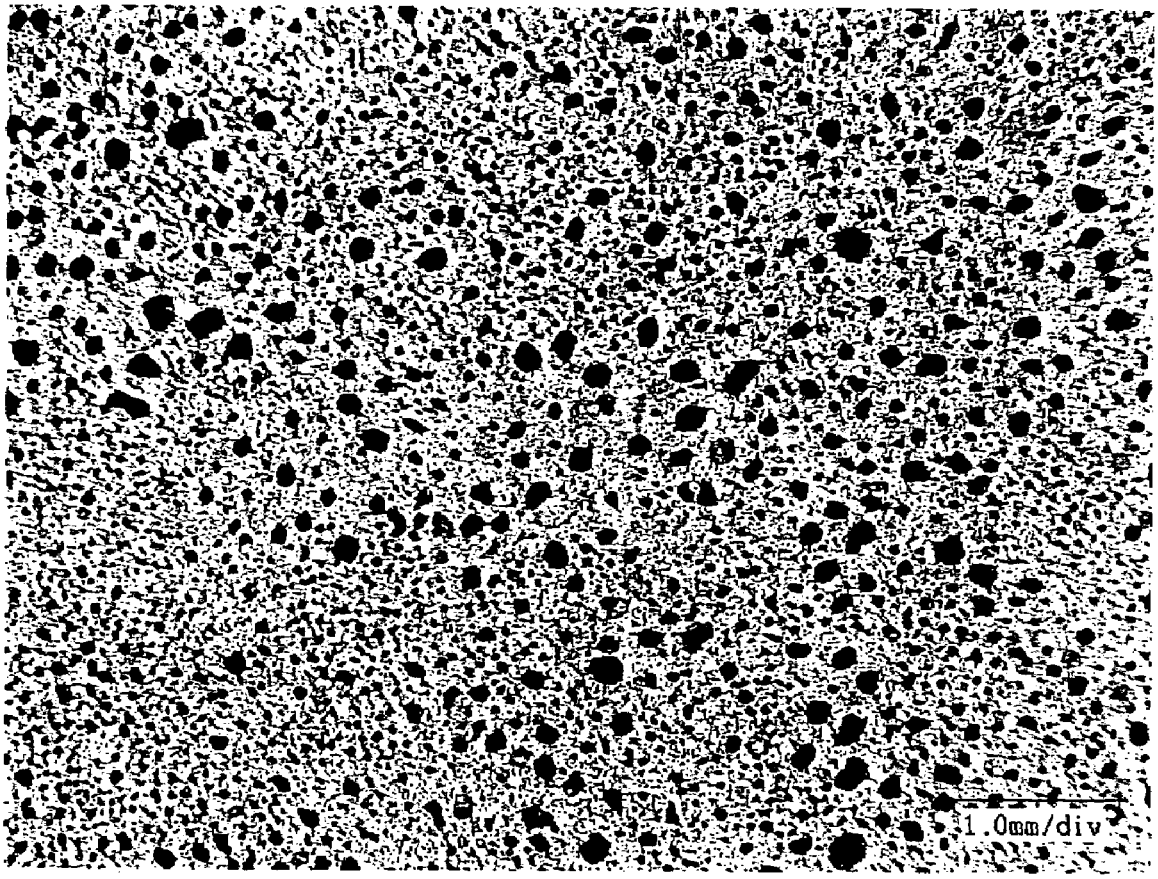
FIG. 20 is an electronically processed image (corresponding to an optical micrograph) illustrating the pore distribution state of a porous nickel material (porosity: 17%) obtained by melting at 1600° C. under pressurization of 0.8 MPa with nitrogen-helium mixed gas.

FIG. 20 shows a portion of a transverse cross section of the porous nickel cylinder obtained as an electronically processed image (corresponding to an optical micrograph).

EXAMPLE 4

A porous copper column (100 mm tall, 30 mm inside diameter) was produced by using the apparatus schematically shown in FIG. 8 and the mold schematically shown in FIG. 10, after which this column was converted to obtain a porous cylinder.

Figure 21:
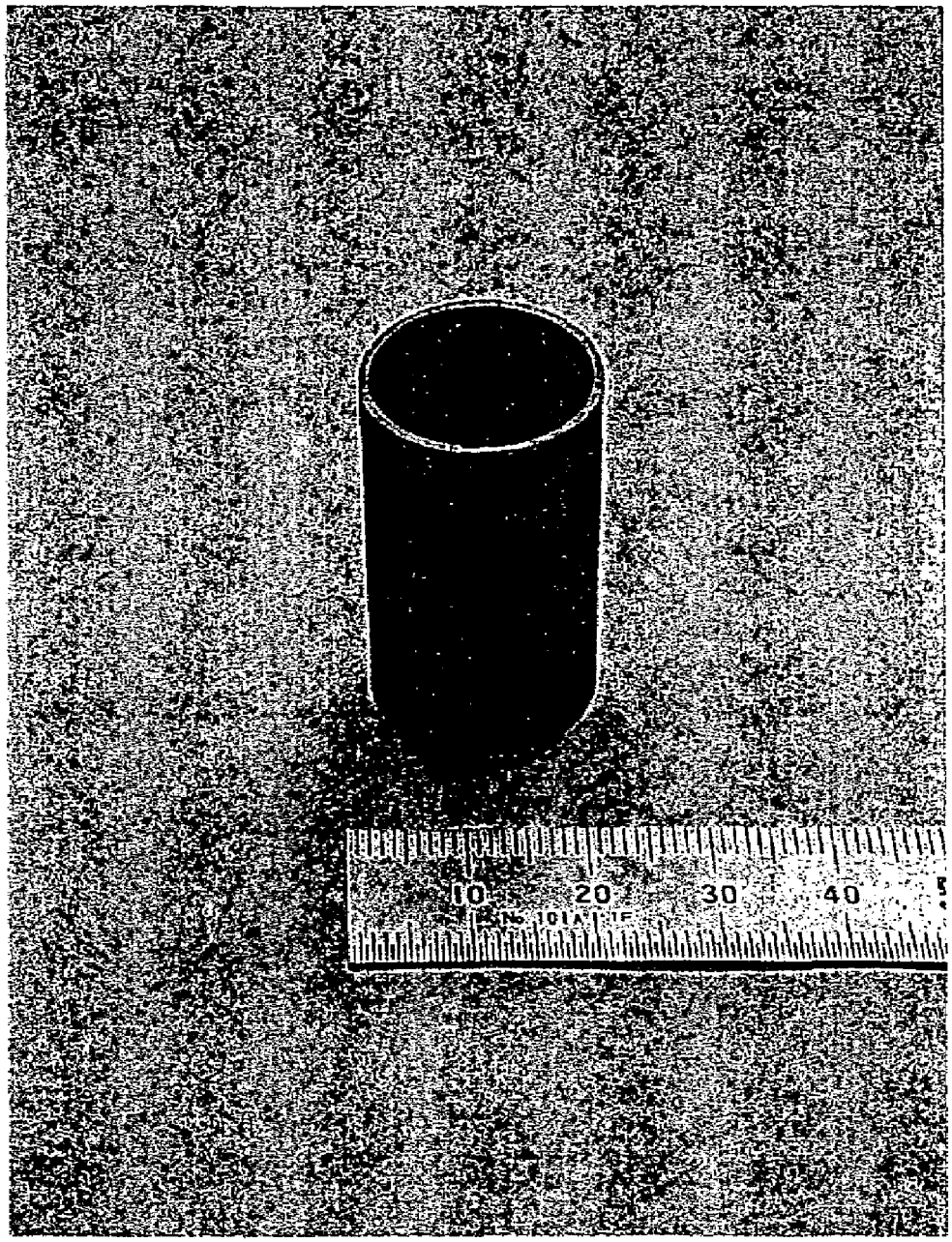
FIG. 21 is an electronically processed image (corresponding to an optical micrograph) illustrating a cylindrical porous copper material obtained by melting at 1250° C. under pressurization of 0.9 MPa with hydrogen-argon mixed gas.

More specifically, the copper raw material (99.99% purity) was maintained for 0.1 hour at 1250° C. and $5\times10^{-2}$ Torr, and then melted for 0.5 hour at 1250° C. under a pressurizing gas atmosphere (0.3 MPa $H_2$+0.6 MPa Ar). Then, under the same pressurization conditions, the molten copper having the gas as dissolved therein was poured into a cylindrical mold and solidified from the bottom to the top, yielding a porous column. This column was then processed with a wire cutter to obtain a porous copper cylinder with the shape shown in FIG. 21 and having an outside diameter of 20 mm and a thickness of 1 mm.

Figure 22:
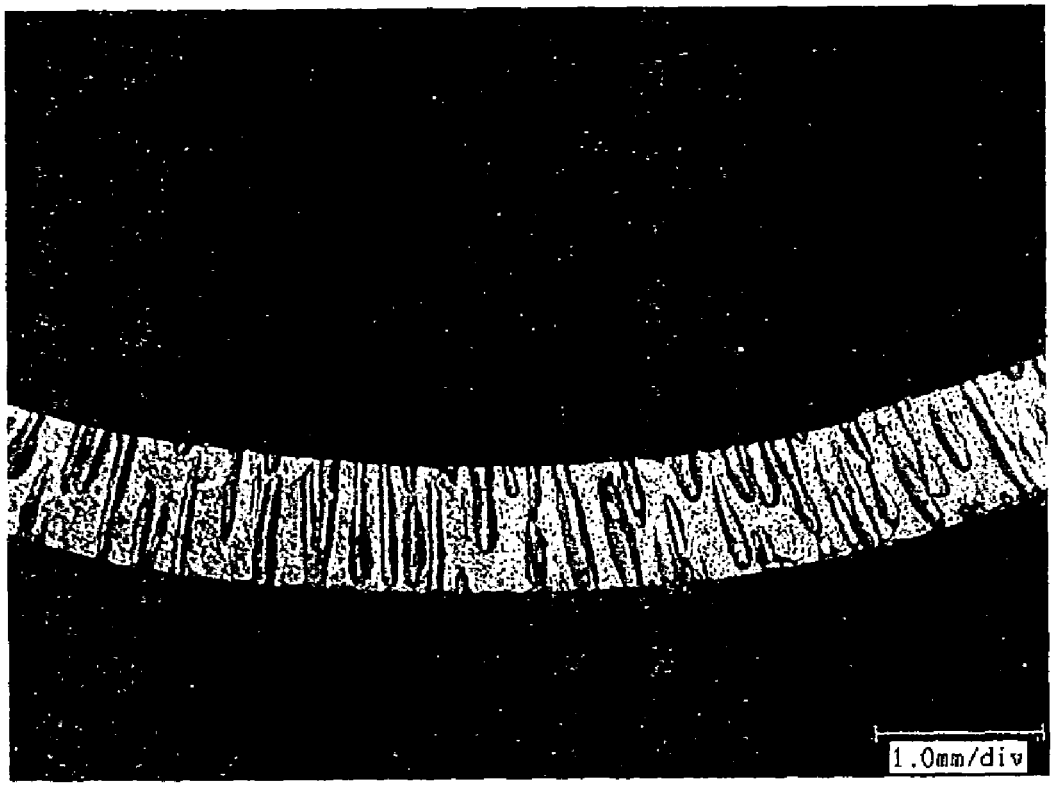
FIG. 22 is an electronically processed image (corresponding to an optical micrograph) showing a cross section of the pore shape in the thickness direction of the cylindrical porous copper material shown in FIG. 21.

FIG. 22 is an electronically processed image (corresponding to an optical micrograph) showing a portion of a horizontal cross section of the porous copper cylinder obtained. It is clear from this image that pores have been formed extending from the inner surface of the cylinder to the peripheral surface.

Figure 23:
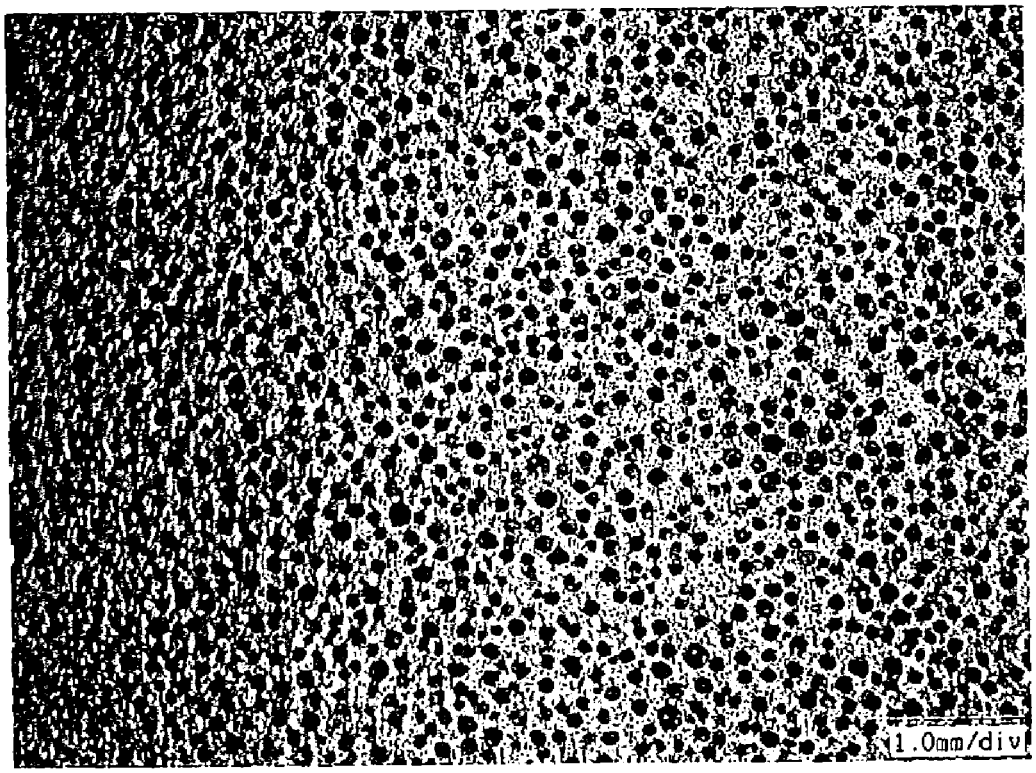
FIG. 23 is an electronically processed image (corresponding to an optical micrograph) showing the surface state of the cylindrical porous copper material shown in FIG. 21.

FIG. 23 is an electronically processed image (corresponding to an optical micrograph) showing a portion of the outer surface of the porous copper cylinder shown in FIG. 22. It is clear from this image that numerous pores have been formed from the inner surface of the cylinder all the way to the outer peripheral surface.

EXAMPLE 5

A porous copper column (100 mm tall, 30 mm inside diameter) was manufactured by using the apparatus schematically shown in FIG. 8 and the mold schematically shown in FIG. 10, and then this column was converted to obtain a porous cylinder.

More specifically, the copper raw material (99.99% purity) was maintained for 0.1 hour at 1250° C. and $5\times10^{-2}$ Torr, and then melted for 0.5 hour at 1250° C. under a pressurizing gas atmosphere (0.3 MPa $H_2$+0.2 MPa Ar). Then, under the same pressurization conditions, the molten copper having the gas as dissolved therein was poured into a cylindrical mold and cooled from the bottom so that it solidified toward the cylindrical mold direction, yielding a porous copper column. This column was then converted with a wire cutter to obtain a porous copper cylinder with the shape shown in FIG. 24 and having an outside diameter of 22 mm and a thickness of 1 mm.

The porous copper cylinder obtained had a such a high porosity that light transmission was visible to the naked eye.

Figure 24:
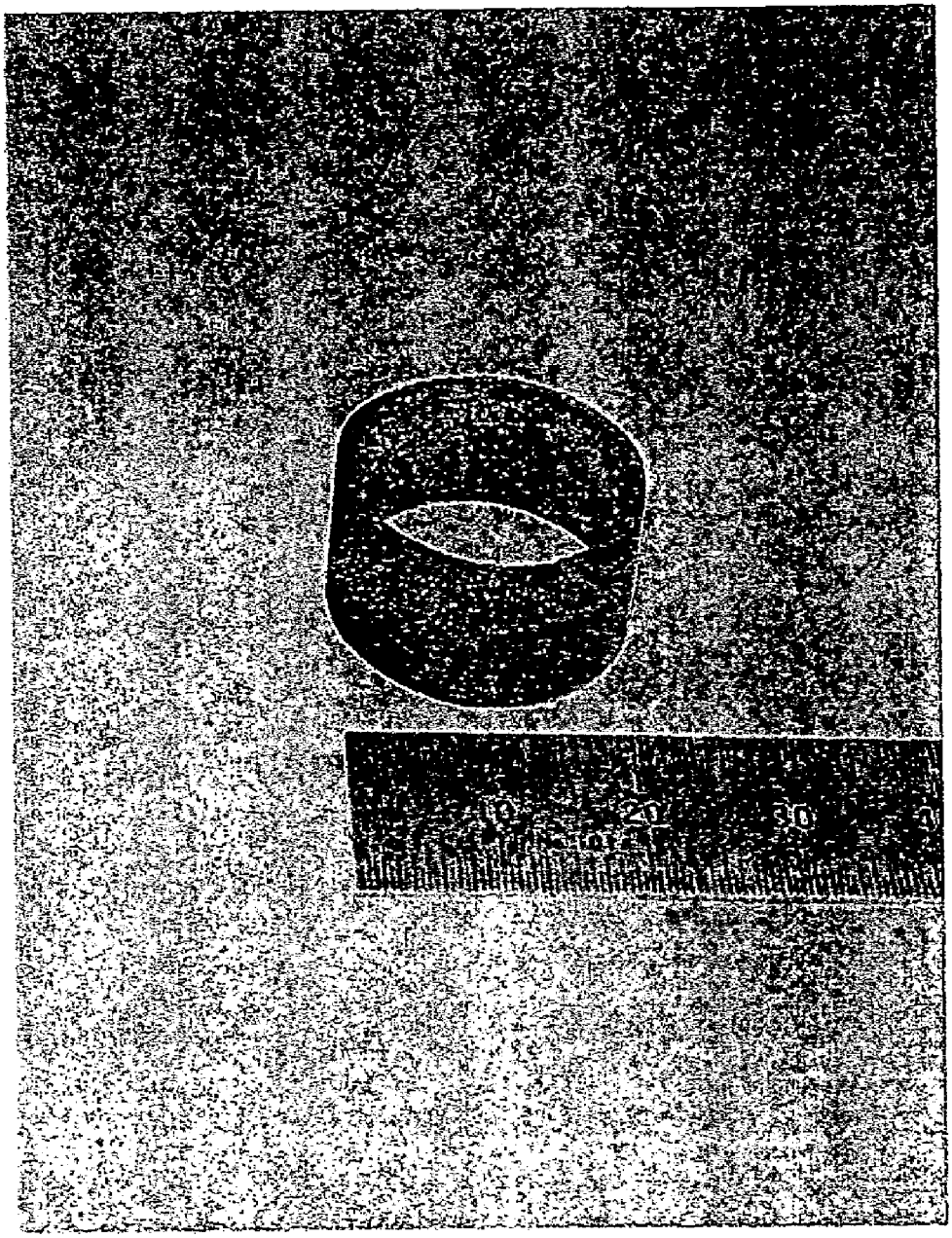
FIG. 24 is an electronically processed image (corresponding to an optical micrograph) showing a cylindrical porous copper material obtained by melting at 1250° C. under pressurization of 0.5 MPa with hydrogen-argon mixed gas.
Figure 25:
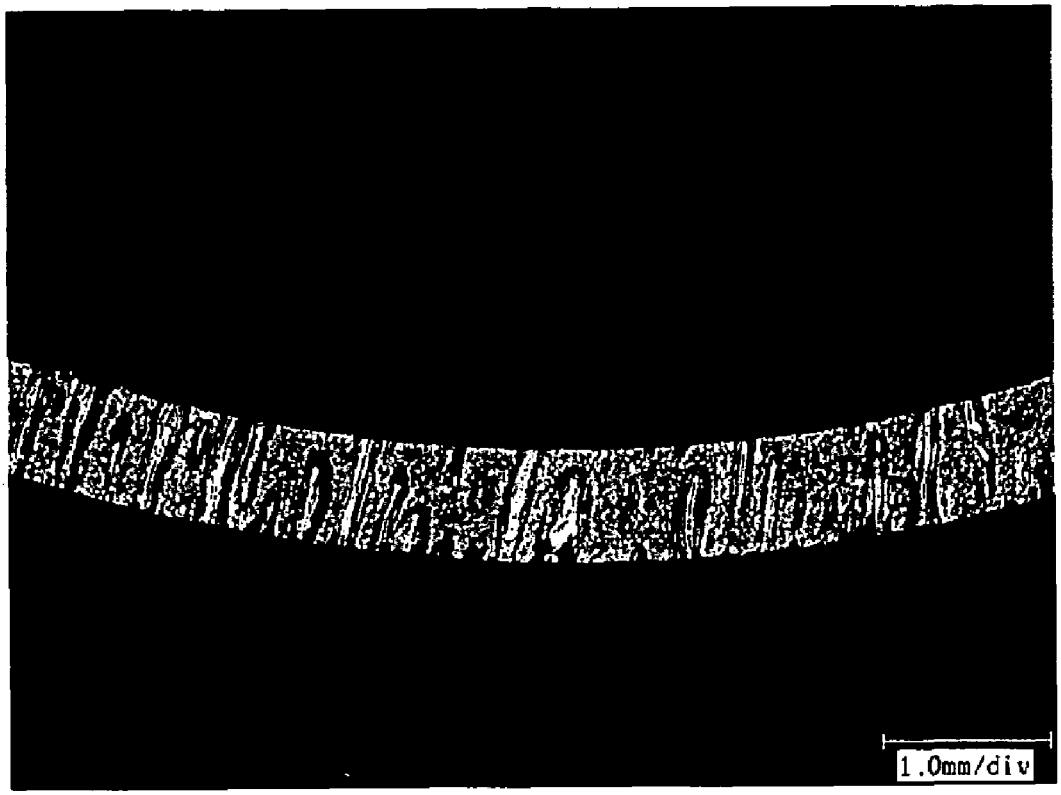
FIG. 25 an electronically processed cross-sectional image (corresponding to an optical micrograph) showing the pore shape in the thickness direction of the cylindrical porous copper material shown in FIG. 24.

FIG. 25 is an electronically processed image (corresponding to an optical micrograph) showing a portion of a transverse cross section of the porous copper cylinder shown in FIG. 24. It is clear from this image that pores have been formed extending from the inner surface of the cylinder to the peripheral surface.

Figure 26:
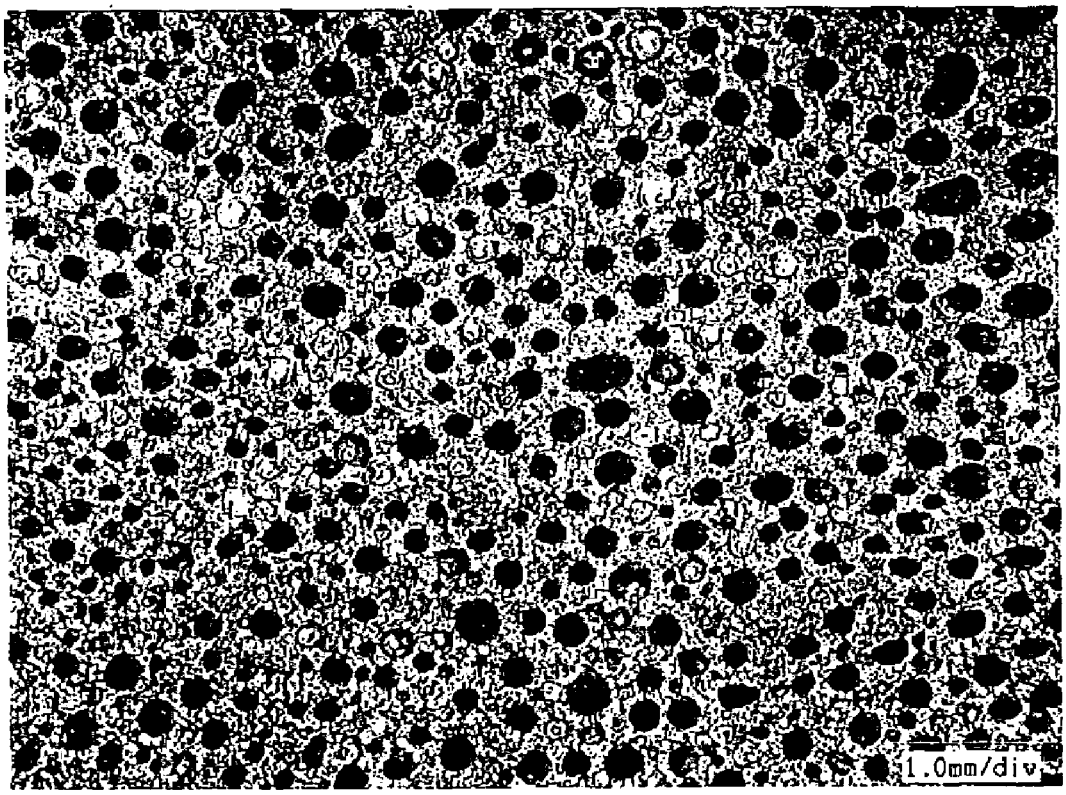
FIG. 26 is an electronically processed image (corresponding to an optical micrograph) showing the surface state of the cylindrical porous copper material shown in FIG. 24.

FIG. 26 is an electronically processed image (corresponding to an optical micrograph) showing a portion of the outer surface of the porous copper cylinder shown in FIG. 24. It is clear from this image that numerous pores have been formed from the inner surface of the cylinder all the way to the outer peripheral surface.

EXAMPLE 6

A porous copper column (100 mm tall, 30 mm outside diameter) was manufactured by using the apparatus schematically shown in FIG. 8 and the mold schematically shown in FIG. 9.

More specifically, the copper raw material (99.99% purity) was maintained for 0.1 hour at 1250° C. and $5\times10^{-2}$ Torr, and then melted for 0.5 hour at 1250° C. under a pressurizing gas atmosphere (0.4 MPa $H_2$+0.4 MPa Ar). Then, under the same pressurization conditions, the molten copper having the gas as dissolved therein was poured into a cylindrical mold and solidified toward the top of the cylindrical mold from the cooling surface at the bottom, yielding a porous copper cylinder with the shape shown in FIG. 14(*c*).

Figure 27:
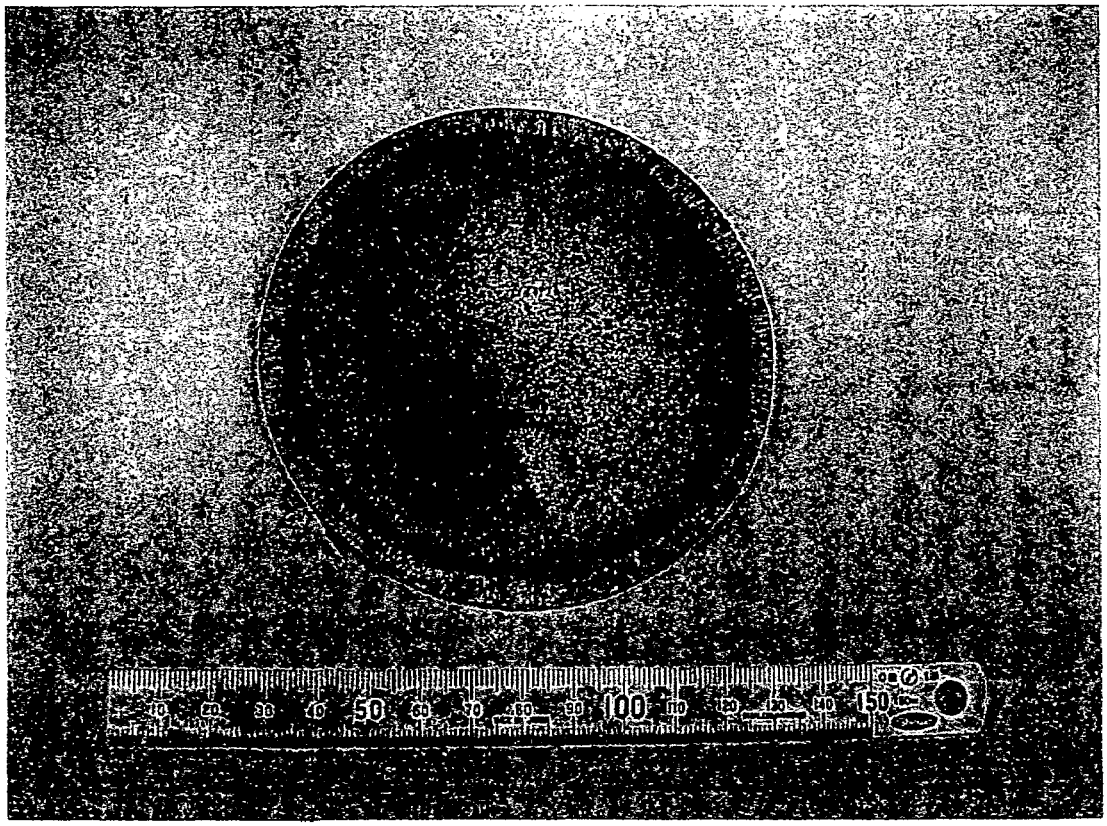
FIG. 27 is an electronically processed image (corresponding to an optical micrograph) showing a transverse cross section of a porous copper cylinder (diameter approximately 100 mm) obtained by melting at 1250° C. under pressurization of 0.8 MPa with hydrogen-argon mixed gas.

A disk-shaped test piece of 3 mm thickness was cut from this cylinder and placed on a white paper. Light was irradiated from above, and formation of the numerous pores of a uniform pore size was confirmed, as shown in FIG. 27.

The invention claimed is:

1. A process for producing a porous metal body, comprising:

(1) maintaining under reduced pressure in the range between $10^{-1}$ and $10^{-6}$ Torr a raw metal material within a temperature range which is 50 to 200° C. lower than the melting point of the metal in a sealed vessel to thereby degas the raw metal material;

(2) melting the raw metal material under pressurization of between 0.1 and 10 MPa by introducing a gas containing nitrogen gas and one or more gases selected from the group consisting of hydrogen, argon, and helium into the sealed vessel to thereby dissolve the gas in the molten metal; and (3) pouring the molten metal into a mold equipped with a cooling apparatus while controlling the gas pressure above and the temperature of the molten metal, cooling and solidifying the molten metal in the mold inside the sealed vessel to form a porous metal body.

2. The process for producing a porous metal body according to claim 1, wherein the raw metal material is selected from the group consisting of iron, copper, nickel, cobalt, magnesium, aluminum, titanium, chromium, tungsten, manganese, molybdenum, beryllium and alloys comprising one or more of these metals.

3. The process for producing a porous metal body according to claim 1, wherein the pressure applied in step (2) is between 0.2 and 2.5 MPa.

4. The process for producing a porous metal body according to claim 1, wherein the cooling and solidification of the molten metal in step (3) is performed by a continuous casting method.

5. The process for producing a porous metal body according to claim 1, wherein said gas is a nitrogen-argon mixture, a nitrogen-helium mixture or a nitrogen-argon-helium mixture.

6. A method for producing a porous metal comprising:

holding a metal under a pressure of between $10^1$ and $10^6$ Torr and at a temperature lower by 50 to 200° C. than the melting point of the metal in a sealed vessel, thereby degassing the metal;

melting the metal under a pressure of between 0.1 and 10 MPa while introducing a gas mixture containing nitrogen gas and at least one gas selected from the group consisting of hydrogen, argon, and helium into the sealed vessel, thereby dissolving a part of the gas in the molten metal; and pouring the molten metal into a mold, and cooling and solidifying the molten metal in the mold to produce a porous metal.

7. The method according to claim 6, wherein said gas mixture is a nitrogen-argon mixture, a nitrogen-helium mixture or a nitrogen-argon-helium mixture.

8. The method according to claim 6, wherein the gas mixture contains hydrogen.

9. A process for producing a porous metal body, comprising:

(1) maintaining under reduced pressure in the range between $10^{-1}$ and $10^{-6}$ Torr a raw metal material within a temperature range which is 50 to 200° C. lower than the melting point of the metal in a sealed vessel to thereby degas the raw metal material;

(2) melting the raw metal material under pressurization of between 0.1 and 10 MPa by introducing a gas containing a nitrogen-argon mixture, a nitrogen-helium mixture or a nitrogen-argon-helium mixture into the sealed vessel to thereby dissolve the gas in the molten metal; and (3) pouring the molten metal into a mold equipped with a cooling apparatus while controlling the gas pressure above and the temperature of the molten metal, cooling and solidifying the molten metal in the mold inside the sealed vessel to form a porous metal body.

10. The process for producing a porous metal body according to claim 9, wherein the raw metal material is selected from the group consisting of iron, copper, nickel, cobalt, magnesium, aluminum, titanium, chromium, tungsten, manganese, molybdenum, beryllium, and alloys comprising one or more of these metals.

11. The process for producing a porous metal body according to claim 9, wherein the pressure applied in step (2) is between 0.2 and 2.5 MPa.

12. The process for producing a porous metal body according to claim 9, wherein the cooling and solidification of the molten metal in step (3) is performed by a continuous casting method.

13. A method for producing a porous metal comprising:

holding a metal under a pressure of between $10^{-1}$ and $10^{-6}$ Torr and at a temperature lower by 50 to 200° C. than the melting point of the metal in a sealed vessel, thereby degassing the metal;

melting the metal under a pressure of between 0.1 and 10 MPa while introducing a nitrogen-argon mixture, a nitrogen-helium mixture or a nitrogen-argon-helium mixture into the sealed vessel, thereby dissolving a part of the gas in the molten metal; and pouring the molten metal into a mold, and cooling and solidifying the molten metal in the mold to produce a porous metal.

14. A process for producing a porous metal body, comprising:

(1) maintaining under reduced pressure in the range between $10^{-1}$ and $10^{-6}$ Torr a raw metal material within a temperature range which is 50 to 200° C. lower than the melting point of the metal in a sealed vessel to thereby degas the raw metal material;

(2) melting the raw metal material under pressurization of between 0.1 and 10 MPa by introducing a nitrogen gas into the sealed vessel to thereby dissolve the gas in the molten metal; and (3) pouring the molten metal into a mold equipped with a cooling apparatus while controlling the gas pressure above and the temperature of the molten metal, cooling and solidifying the molten metal in the mold inside the sealed vessel to form a porous metal body.

* * * * *